US007990408B2

(12) United States Patent
Yoshioka et al.

(10) Patent No.: US 7,990,408 B2
(45) Date of Patent: Aug. 2, 2011

(54) EXPOSING DEVICE AND IMAGE FORMING APPARATUS INCLUDING THE SAME

(75) Inventors: Kenjiro Yoshioka, Shiojiri (JP); Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 485 days.

(21) Appl. No.: 12/198,377

(22) Filed: Aug. 26, 2008

(65) Prior Publication Data

US 2009/0074464 A1 Mar. 19, 2009

(30) Foreign Application Priority Data

Sep. 13, 2007 (JP) ..... 2007-237643
Jun. 6, 2008 (JP) ..... 2008-148924

(51) Int. Cl.
*B41J 2/45* (2006.01)
*B41J 2/15* (2006.01)
*B41J 27/00* (2006.01)

(52) U.S. Cl. ..... 347/238; 347/241; 347/242; 347/244; 347/256; 347/257; 347/258

(58) Field of Classification Search ..... 347/238, 347/241, 242, 244, 256–258
See application file for complete search history.

(56) References Cited

U.S. PATENT DOCUMENTS 6,025,863 A * 2/2000 Nakajima et al. ..... 347/238
7,057,634 B2 * 6/2006 Makino ..... 347/242
2002/0101501 A1 * 8/2002 Miyagawa ..... 347/238

FOREIGN PATENT DOCUMENTS

JP 06-278314 10/1994
JP 2001-063139 3/2001

* cited by examiner

*Primary Examiner* — Stephen Meier
*Assistant Examiner* — Sarah Al-Hashimi
(74) *Attorney, Agent, or Firm* — DLA Piper LLP (US)

(57) ABSTRACT

An exposing device includes a light-emitting element array including plural light-emitting elements disposed in a first direction and a second direction orthogonal to or substantially orthogonal to the first direction, a lens array including plural lenses that focus lights from the light-emitting elements, a supporting member that supports the light-emitting element array and the lens array, and an exposure-position adjusting mechanism including a rotation adjusting unit that rotates the supporting member around or substantially around an axis in the first direction.

10 Claims, 12 Drawing Sheets

EXPOSING DEVICE AND IMAGE FORMING APPARATUS INCLUDING THE SAME

BACKGROUND

1. Technical Field

The present invention relates to a technical field of an exposing device including light-emitting element arrays having plural light-emitting elements and lens arrays having plural lenses that focus lights from the light-emitting elements. The present invention also relates to a technical field of an image forming apparatus of an electrophotographic system such as a copying machine, a facsimile, or a printer that includes the exposing device and uses a liquid developer.

2. Related Art

An exposing device including light-emitting element arrays having plural light-emitting elements two-dimensionally disposed, respectively, and lens arrays having plural lenses that focus lights from the light-emitting elements has been proposed (see, for example, JP-A-6-278314 and JP-A-2001-63139). In the exposing device disclosed in JP-A-6-278314, the light-emitting element arrays and the lens arrays are disposed in a first direction as a main scanning direction and a second direction as a scanning direction orthogonal to or substantially orthogonal to the first direction. A photosensitive member is exposed in spots of two rows by the lights from the light-emitting elements. In the exposing device disclosed in JP-A-2001-63139, lights from the light-emitting elements in plural rows is irradiated on a photosensitive member in a line shape to form a latent image. In that case, the lights from all the light-emitting elements are focused on the photosensitive member by one optical system lens.

When the lens arrays are used, it is possible to use light-emitting elements larger than those used in an exposing device in the past in which the lens arrays are not used. Therefore, advantages such as an increase in exposure intensity, the extension of durable life, and an increase in selections of light-emitting elements are realized by using the lens arrays.

On the other hand, when the lens arrays are used, it is difficult to focus the lights from the light-emitting elements on the photosensitive member. Therefore, when the exposing device including light-emitting element arrays and lens arrays two-dimensionally arrayed, respectively, is built in an imaging forming apparatus, the lights may be defocused. Therefore, exposing devices that satisfy predetermined criteria for focusing and pass a test decrease. As a result, the yield of exposing devices falls.

However, it is difficult to effectively solve this problem with the exposing devices disclosed in JP-A-6-278314 and JP-A-2001-63139.

SUMMARY

An advantage of some aspects of the invention is to provide an exposing device that can highly accurately focus lights even if lens arrays and light-emitting elements are used and an image forming apparatus including the exposing device.

According to an aspect of the invention, there are provided an exposing device and an image forming apparatus including an exposure-position adjusting mechanism that moves a supporting member for supporting light-emitting element arrays and lens arrays and adjusts an exposure position for a photosensitive member. This makes it possible to set exposure positions of respective light-emitting elements in focused positions. Therefore, in conjunction with the advantage of the lens array described above, it is possible to draw a focused satisfactory latent image on an image bearing member.

It is preferable that the exposure-position adjusting mechanism includes a rotary exposure-position adjusting unit that rotates the supporting member around an axis in a first direction. This makes it possible to easily set exposure positions of the respective light-emitting elements in a second direction orthogonal to or substantially orthogonal to the first direction in more highly accurately focused positions. It is preferable that the first direction is set to extend along a longitudinal direction of the photosensitive member.

It is preferable that the exposure-position adjusting mechanism includes a second-direction exposure-position adjusting unit that moves the supporting member in the second direction. This makes it possible to easily set the exposure positions of the respective light-emitting elements in still more highly accurately focused positions.

It is preferable that one side end in the first direction of the supporting member is supported at two points in the second direction on the photosensitive member or a flange that supports the photosensitive member or one side end of the supporting member is supported at two or more points in the second direction on the photosensitive member or the flange that supports the photosensitive member and the other side end of the supporting member is supported at one or more points on the photosensitive member or the flange that supports the photosensitive member. This makes it possible to simplify the rotary exposure-position adjusting mechanism. In particular, when the light-emitting element arrays and the lens arrays are supported on the flange that supports the photosensitive member, it is possible to suppress the influence of vibration caused by the photosensitive member and stably draw an image.

It is preferable that maximum width in the second direction of a supporting point at one side end of the supporting member supported on the photosensitive member or the flange that supports the photosensitive member is set larger than maximum width in the second direction of an irradiation area in the photosensitive member on which lights from the light-emitting elements are irradiated. This makes it possible to perform stable positioning of the exposing device. An adjustment amount of irradiation positions of the respective light-emitting element arrays and the respective lens arrays is small compared with a position adjustment operation amount of irradiation positions of the respective light-emitting elements and the respective lens arrays. This makes it possible to more finely, more accurately, and more easily perform adjustment of the irradiation positions of the respective light-emitting element arrays and the respective lens arrays.

It is preferable that the exposure-position adjusting mechanism includes first and second direction orthogonal-direction exposure-position adjusting units that move the light-emitting element arrays and the lens arrays in a direction orthogonal to both the first and second direction. This also makes it possible to easily set the exposure positions of the respective light-emitting elements in more highly accurately focused positions.

Moreover, since the exposure positions of the respective light-emitting elements can be set in the focused positions, exposing devices that do not pass a test when the exposing devices are built in an image forming apparatus can be reduced. Therefore, it is possible to improve the yield of exposing devices.

It is preferable that the exposing device that can set the exposure positions of the respective light-emitting elements in focused positions is applied to an exposing device of an information processing apparatus that uses a liquid developer.

This makes it possible to suppress disturbance due to ribs of a liquid carrier caused by using the liquid developer even in a one-dot width vertical line (second direction) image having a relatively weak development electric field.

It is preferable that, in the exposing device and the image forming apparatus according to the embodiment, in order to adjust exposure positions, the supporting member that supports the light-emitting element arrays and the lens arrays is moved in the second direction and a center position in the second direction in the exposure positions is adjusted. Subsequently, positions at both ends in the second direction in the exposure positions are adjusted. This makes it possible to more easily set the exposure positions of the respective light-emitting elements in focused positions. In particular, the adjustment of the positions at both the ends in the second direction in the exposure positions is performed by rotating the supporting member around the axis in the first direction. This makes it possible to easily set the exposure positions of the respective light-emitting elements in still more highly accurately focused positions.

BRIEF DESCRIPTION OF THE DRAWINGS

The invention will be described with reference to the accompanying drawings, wherein like numbers reference like elements.

FIGS. 12A and 12B are diagrams showing a horizontal line image in a second comparative example, wherein FIG. 12A is a diagram showing a one-dot image and FIG. 12B is a diagram showing a one-to-three-dot vertical line image.

DESCRIPTION OF EXEMPLARY EMBODIMENTS

Exemplary embodiments of the invention are explained below with reference to the accompanying drawings.

Figure 1:
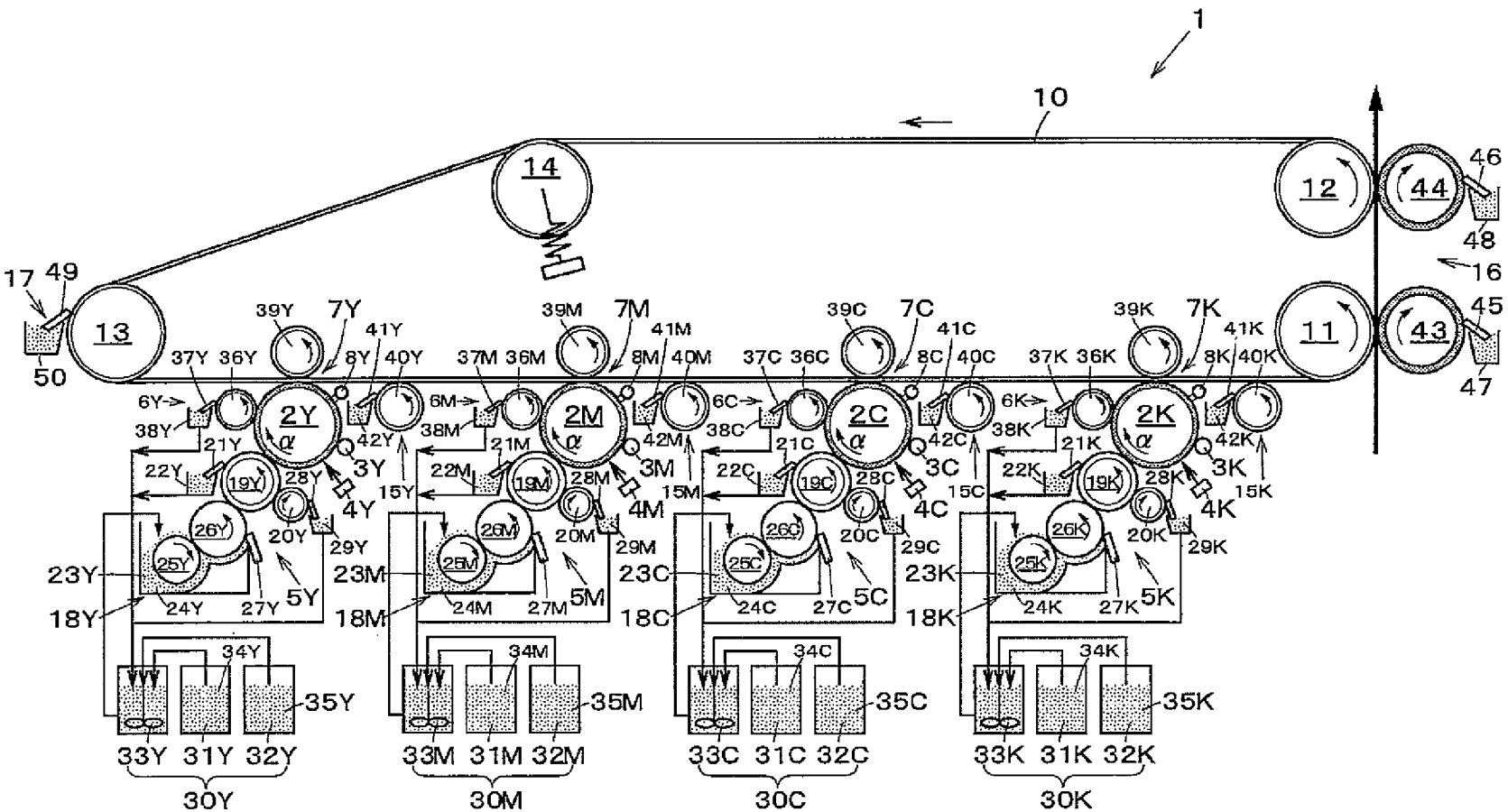
FIG. 1 is a diagram schematically and partially showing an example of an image forming apparatus according to an embodiment of the invention.

FIG. 1 is a diagram schematically and partially showing an example of an image forming apparatus according to an embodiment of the invention.

As shown in FIG. 1, an image forming apparatus 1 of this example includes photosensitive members 2Y, 2M, 2C, and 2K as latent image bearing members for yellow (Y), magenta (M) cyan (C), and black (K) arranged in tandem. In the respective photosensitive members 2Y, 2M, 2C, and 2K, 2Y represents a photosensitive member for yellow, 2M represents a photosensitive member for magenta, 2C represents a photosensitive member for cyan, and 2K represents a photosensitive member for black. Y, M, C, and K for the respective colors are affixed to reference numerals of other components to represent members for the respective colors.

In the example shown in FIG. 1, all the photosensitive members 2Y, 2M, 2C, and 2K are configured by photosensitive drums. The photosensitive members 2Y, 2M, 2C, and 2K may be configured in an endless belt shape.

All the photosensitive members 2Y, 2M, 2C, and 2K are adapted to rotate clockwise as indicated by an arrow a in FIG. 1 when the photosensitive members are actuated. Charging devices 3Y, 3M, 3C, and 2K are provided around the photosensitive members 2Y, 2M, 2C, and 2K, respectively. Exposing devices 4Y, 4M, 4C, and 4K, developing devices 5Y, 5M, 5C, and 5K, photosensitive-member squeezing devices 6Y, 6M, 6C, and 6K, primary transfer devices 7Y, 7M, 7C, and 7K, and charge removing devices 8Y, 8M, 8C, and BK are disposed in order from the charging devices 3Y, 3M, 3C, and 3K toward a rotating direction of the photosensitive members 2Y, 2M, 2C, and 2K, respectively. Although not shown in the figure, photosensitive-member cleaning devices are disposed between the chare removing devices 8Y, 8M, 8C, and 8K and the charging devices 3Y, 3M, 3C, and 3K, respectively.

The imaging forming apparatus 1 includes an endless intermediate transfer belt 10 as an intermediate transfer medium. The intermediate transfer belt 10 is looped around a belt driving roller 11 and a pair of driven rollers 12 and 13, to which driving force of a not-shown motor is transmitted, and provided to be rotatable counterclockwise in FIG. 1. In that case, the belt driving roller 11 and one driven roller 12 are disposed adjacent to each other and a predetermined space away from each other in a moving direction (a down to up direction in FIG. 1) of a recording material such as paper conveyed thereto indicated by an arrow. Moreover, the belt driving roller 11 and the other driven roller 13 are disposed to be separated from each other along a tandem arrangement direction of the respective photosensitive members 2Y, 2M, 2C, and 2K. Furthermore, predetermined tension is applied to the intermediate transfer belt 10 by a tension roller 14 to eliminate the sag of the intermediate transfer belt 10.

In the image forming apparatus 1 of this example, the respective photosensitive members 2Y, 2M, 2C, and 2K and the respective developing devices 5Y, 5M, 5C, and 5K are disposed in order of the colors Y, M, C, and K from an upstream side in a moving direction of the intermediate transfer belt 10. However, an arrangement order of the colors Y, M, C, and K can be arbitrarily set.

Near the primary transfer devices 7Y, 7M, 7C, and 7K further on a downstream side in the rotating direction of the intermediate transfer belt 10 than the primary transfer devices 7Y, 7M, 7C, and 7K, intermediate-transfer-belt squeezing devices 15Y, 15M, 15C, and 15K are disposed, respectively. A secondary transfer device 16 is provided on the belt driving roller 11 side of the intermediate transfer belt 10. An intermediate-transfer-belt cleaning device 17 is provided on the driven roller 13 side of the intermediate transfer belt 10.

Although not shown in the figure, like a general image forming apparatus in the past that performs secondary transfer, the image forming apparatus 1 of this example includes, further on an upstream side in a recording material conveying direction than the secondary transfer device 16, a recording-material storing device that stores a recording material such as paper and a registration roller pair that conveys and supplies the recording material, which is fed from the recording material storing device, to secondary transfer device 16. The image forming apparatus 1 includes, further on a downstream side in the recording material conveying direction than the secondary transfer device 16, a fixing device and a paper discharge tray.

The charging devices 3Y, 3M, 3C, and 3K include charging members such as charging rollers, respectively. Biases having the same polarity as a charging polarity of a liquid developer are applied to the respective charging devices 3Y, 3M, 3C, and 3K from a not-shown power supply device. The charging devices 3Y, 3M, 3C, and 3K charge the photosensitive members 2Y, 2M, 2C, and 2K corresponding thereto, respectively.

Figure 2:
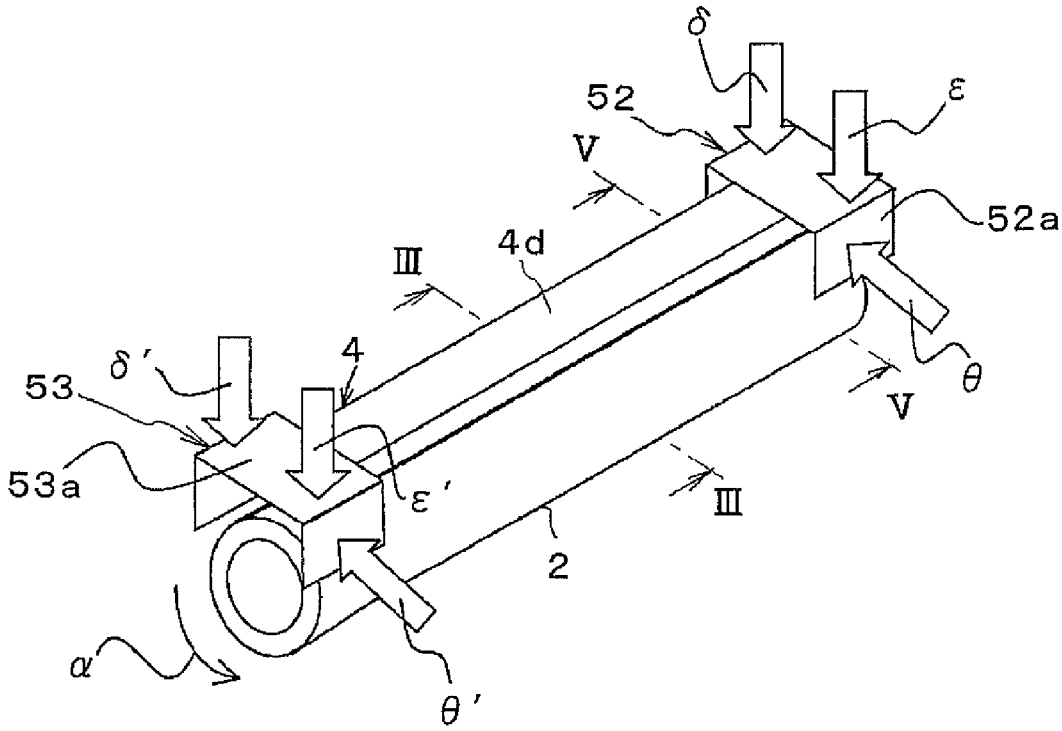
FIG. 2 is a perspective view of an exposing device used in the image forming apparatus shown in FIG. 1.
Figure 3:
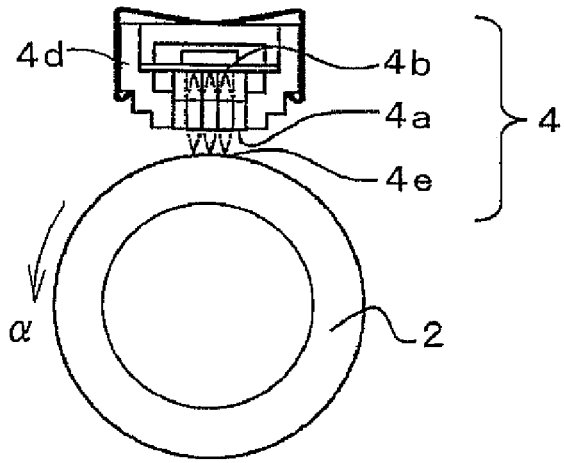
FIG. 3 is a diagram schematically showing a section taken along line III-III in FIG. 2.

FIG. 2 is a perspective view of an exposing device. FIG. 3 is a diagram schematically showing a cross section of the exposing device. All the exposing devices 4Y, 4M, 4C, and 4K have the same configuration. Therefore, in the following explanation of the exposing device, as shown in FIGS. 2 and 3, the reference signs Y, M, C, and K of the exposing devices 4Y, 4M, 4C, and 4K are omitted.

In FIGS. 2 and 3, the exposing device 4 includes light-emitting element arrays having lens arrays 4*a* and plural light-emitting elements 4*b*. The lens arrays 4*a* and the light-emitting elements 4*b* are linearly arrayed in predetermined numbers, respectively, in a main scanning direction as a first direction along a longitudinal direction of the photosensitive member 2 (an axial direction of the photosensitive member 2). Moreover, rows of the lens arrays 4*a* and the light-emitting elements 4*b* are two-dimensionally arrayed in a matrix shape in predetermined number of rows (in the example shown in the figure, three rows; in the following explanation, the number of rows is three), respectively, in a sub-scanning direction (a moving direction of the photosensitive member 2) as a second direction orthogonal to or substantially orthogonal to the first direction. In that case, the lens arrays 4*a* and the light-emitting elements 4*b* are arrayed in a long shape in the main scanning direction. The number of the light-emitting elements 4*b* is set to be equal to or larger than the number of the lens arrays 4*a*.

The lens arrays 4*a* and the light-emitting elements 4*b* are supported by a light-emitting-element supporting member 4*d* (equivalent to the supporting member of the invention) extended along the main scanning direction. In that case, a predetermined number of the lens arrays 4*a* are arranged adjacent to one another for each of the rows. The light-emitting elements 4*b* are arranged corresponding to each of the lens arrays 4*a* in the three rows to form a light-emitting element group. The lens arrays 4*a* and the light-emitting elements 4*b* arrayed in the three rows in parallel and the light-emitting-element supporting member 4*d* configure a line head in the exposing device 4 of this example.

The respective rows of the lens arrays 4*a* and the light-emitting elements 4*b* are arranged such that a second row in the center is adjacent to a first row at the right end and a third row on the left side is adjacent to the second row in the center in FIG. 3. In the light-emitting elements 4*b* of the light-emitting element group, for example, a semiconductor laser, an LED, an organic EL, and the like can be used. Lights emitted from the respective light-emitting elements 4*b* are focused and irradiated on the surface of the photosensitive member 2 through the lens arrays 4*a* corresponding thereto. In that case, the lights from the respective light-emitting elements 4*b* are irradiated on the surface of the photosensitive member 2 in beam spots 4*e*, which are a range in which the lights can be focused. Consequently, printing (drawing of an image) on the photosensitive member 2 is performed and an electrostatic latent image is formed on the surface of the photosensitive member 2.

Figure 4:
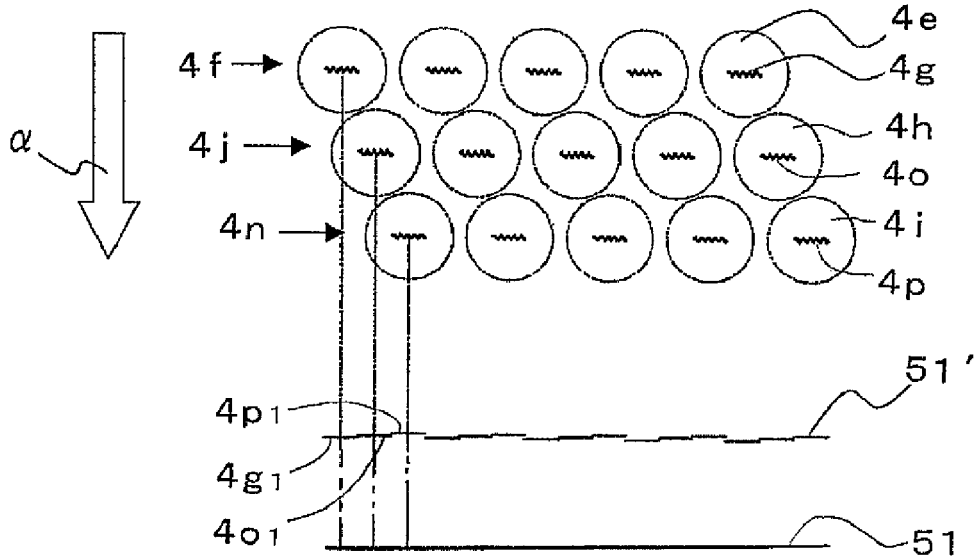
FIG. 4 is a diagram for explaining beam spots and focusing by the exposing device shown in FIG. 2.

For example, when a horizontal line (a straight line extending in the axial direction of the photosensitive member 2) is printed on the photosensitive member 2 by the respective light-emitting elements 4*b*, lights are irradiated on the photosensitive member 2 in the beam spots 4*e* by the lighting of the light-emitting elements 4*b* in the first row. Consequently, a first beam spot horizontal row 4*f* is formed on the photosensitive member 2 as shown in FIG. 4. At this point, in the respective beam spots 4*e*, the potential of the photosensitive member 2 is reduced by the irradiation of the lights from the respective light-emitting elements 4*b* and focused images 4*g* are formed. Since lights are weak in areas other than the focused images 4*g* in the beam spots 4*e*, the potential of the photosensitive member 2 is not reduced and focused images are not formed. Electrostatic latent images $\mathbf{4}g_1$ of a horizontal line image are printed on the surface of the photosensitive member 2 by the focused images 4*g*.

Similarly, lights are irradiated in beam spots 4*h* and 4*i* by the respective light-emitting elements 4*b* in the second and third rows. Consequently, second and third beam spot horizontal rows 4*j* and 4*n* are formed on the photosensitive member 2, respectively. Electrostatic latent images $\mathbf{4}o_1$ and $\mathbf{4}p_1$ of horizontal line images are respectively printed on the surface of the photosensitive member 2 by the focused images 4*o* and 4*p* formed in the respective beam spots 4*h* and 4*i*.

The respective light-emitting elements 4*b* in the first to third rows are lighted according to rotating speed of the photosensitive member 2 such that the electrostatic latent images $\mathbf{4}g_1$, $\mathbf{4}o_1$, and $\mathbf{4}p_1$ of the respective horizontal line images formed by the respective light-emitting elements 4*b* of the respective rows form an electrostatic latent image 51 of a horizontal straight line. In other words, when the photosensitive member 2 rotates in an arrow a direction (counterclockwise in FIG. 3), first, the respective light-emitting elements 4*b* in the first row are lighted. Subsequently, the respective light-emitting elements 4*b* in the second row are lighted according to the rotating speed of the photosensitive member 2. Lastly, the respective light-emitting elements 4*b* in the third row are lighted according to the rotating speed of the photosensitive member 2. In that case, if the rotation of the photosensitive member 2 becomes irregular, an electrostatic latent image is not the horizontal straight line and an irregular electrostatic latent image 51' is formed. Therefore, it is necessary to prevent the rotation of the photosensitive member 2 from becoming irregular as much as possible.

The developing devices 5Y, 5M, 5C, and 5K respectively include developer supplying units 18Y, 18M, 18C, and 18K, developing rollers 19Y, 19M, 19C, and 19K, compaction rollers 20Y, 20M, 20C, and 20K, developing roller cleaners 21Y, 21M, 21C, and 21K, and developing-roller-cleaner collected-liquid storing units 22Y, 22M, 22C, and 22K.

The developer supplying units 18Y, 18M, 18C, and 18K respectively include developer containers 24Y, 24M, 24C, and 24K that store liquid developers 23Y, 23M, 23C, and 23K including toner particles as solid content toners and nonvolatile liquid carriers, developer pumping rollers 25Y, 25M, 25C, and 25K, anilox rollers 26Y, 26M, 26C, and 26K, and developer regulating blades 27Y, 27M, 27C, and 27K.

All the liquid developers 23Y, 23M, 23C, and 23K stored in the developer containers 24Y, 24M, 24C, and 24K are formed by dispersing the solid content toners (toner particles) (charged during image formation) in the nonvolatile liquid carriers (e.g., insulating oils that do not fail to catch charges of the toners such as silicone oil or mineral oil). As the toner particles, it is possible to use particles having an average particle diameter of, for example, 1 μm formed by dispersing publicly-known colorants such as pigments in publicly-known thermoplastic resin used in toners.

The developer pumping rollers 25Y, 25M, 25C, and 25K are rollers that pump up the liquid developers 23Y, 23M, 23C, and 23K in the developer containers 24Y, 24M, 24C, and 24K, respectively, and supply the liquid developers 23Y, 23M, 23C, and 23K to the anilox rollers 26Y, 26M, 26C, and 26K, respectively. All the developer pumping rollers 25Y, 25M, 25C, and 25K are adapted to rotate clockwise as indicated by an arrow in FIG. 1. All the anilox rollers 26Y, 26M, 26C, and 26K are rollers made of cylindrical members and have spiral grooves finely and uniformly formed on the surfaces thereof. As dimensions of the grooves, for example, a groove pitch is set to about 170 μm and groove depth is set to about 30 μm. It goes without saying that the dimensions of the grooves are not limited to these values. All the anilox rollers 26Y, 26M, 26C, and 26K are adapted to rotate in the same direction as the developing rollers 19Y, 19M, 19C, and 19M and counterclockwise as indicated by an arrow in FIG. 1. All the anilox rollers 26Y, 26M, 26C, and 26K can also be adapted to rotate following the developing rollers 19Y, 19M, 19C, and 19K. In other words, a rotating direction of the anilox rollers 26Y, 26M, 26C, and 26K is not limited and is arbitrary.

The developer regulating blades 27Y, 27M, 27C, and 27K are provided in contact with the surfaces of the anilox rollers 26Y, 26M, 26C, and 26K, respectively. The developer regulating blades 27Y, 27M, 27C, and 27K respectively include rubber sections made of urethane rubber that come into contact with the surfaces of the anilox rollers 26Y, 26M, 26C, and 26K and plates of metal or the like that support the rubber sections. The developer regulating blades 27Y, 27M, 27C, and 27K respectively scrape off and remove, with the rubber sections thereof, the liquid developers adhering to the surfaces other than the grooves of the anilox rollers 26Y, 26M, 26C, and 26K. Therefore, the anilox rollers 26Y, 26M, 26C, and 26K respectively supply only the liquid developers adhering in the grooves to the developing rollers 19Y, 19M, 19C, and 19K.

All the developing rollers 19Y, 19M, 19C, and 19K are cylindrical members having the width of, for example, about 320 mm and include elastic members of conductive urethane rubbers or the like and resin layers or rubber layers in outer peripheries of metal shafts of iron or the like. The developing rollers 19Y, 19M, 19C, and 19K are respectively brought into contact with the photosensitive members 2Y, 2M, 2C, and 2K and adapted to rotate counterclockwise as indicated by the arrow in FIG. 1.

The compaction rollers 20Y, 20M, 20C, and 20K are adapted to rotate clockwise as indicated by the arrow in FIG. 1. The compaction rollers 20Y, 20M, 20C, and 20K are respectively applied with voltages and charge the developing rollers 19Y, 19M, 19C, and 19K corresponding thereto, respectively. In that case, the applied voltages to the respective compaction rollers 20Y, 20M, 20C, and 20K are set to DC voltages. The applied voltages to the respective compaction rollers 20Y, 20M, 20C, and 20K can be set to voltages obtained by superimposing AC voltages on the DC voltages. Regardless of whether the applied voltages to the respective compaction rollers 20Y, 20M, 20C, and 20K are only the DC voltages or the superimposed voltages of the DC voltages and the AC voltages, the applied voltages are set larger than a discharge start voltage for starting discharge according to the Paschen's law between the respective compaction rollers 20Y, 20M, 20C, and 20K and the respective developing rollers 19Y, 19M, 19C, and 19K.

The liquid developers 23Y, 23M, 23C, and 23K on the developing rollers 19Y, 19M, 19C, and 19K are respectively pressed against the developing rollers 19Y, 19M, 19C, and 19K according to the charging of the developing rollers 19Y, 19M, 19C, and 19K by the compaction rollers 20Y, 20M, 20C, and 20K.

The electric resistances of the compaction rollers 20Y, 20M, 20C, and 20K are relatively important. When the resistances of the compaction rollers 20Y, 20M, 20C, and 20K are low, spark discharge occurs and damages the developing rollers 19Y, 19M, 19C, and 19K, the compaction rollers 20Y, 20M, 20C, and 20K, and the liquid developers 23Y, 23M, 23C, and 23K. Therefore, in uniformly performing satisfactory compaction of the liquid developers 23Y, 23M, 23C, and 23K without causing such a damage, it is preferable that the compaction rollers 20Y, 20M, 20C, and 20K have actual resistances equal to or higher than Log 7 Ω.

Although not clearly shown in FIG. 1, outer peripheral surfaces of the compaction rollers 20Y, 20M, 20C, and 20K are respectively arranged predetermined gaps (μm) away from outer peripheral surfaces of the developing rollers 19Y, 19M, 19C, and 19K corresponding thereto, respectively. In that case, the respective gaps are set larger than the thickness (μm) of developer layers formed on the outer peripheral surfaces of the respective developing rollers 19Y, 19M, 19C, and 19K by the liquid developers 23Y, 23M, 23C, and 23K supplied from the respective anilox rollers 26Y, 26M, 26C, and 26K. Therefore, the compaction rollers 20Y, 20M, 20C, and 20K respectively apply non-contact compaction to the liquid developers 23Y, 23M, 23C, and 23K on the developing rollers 19Y, 19M, 19C, and 19K.

In the compaction rollers 20Y, 20M, 20C, and 20K, compaction roller cleaner blades 28Y, 28M, 28C, and 28K and compaction-roller-cleaner collected-liquid storing units 29Y, 29M, 29C, and 29K are provided, respectively. The compaction roller cleaner blades 28Y, 28M, 28C, and 28K are respectively formed of, for example, rubber that comes into contact with the surfaces of the compaction rollers 20Y, 20M, 20C, and 20K corresponding thereto, respectively, and used for scraping off and removing developers remaining on the compaction rollers 20Y, 20M, 20C, and 20K. The compaction-roller-cleaner collected-liquid storing units 29Y, 29M, 29C, and 29K respectively include containers such as tanks that store the developers scraped off from the compaction rollers 20Y, 20M, 20C, and 20K by the compaction roller cleaner blades 28Y, 28M, 28C, and 28K.

The developing roller cleaners 21Y, 21M, 21C, and 21K are respectively made of, for example, rubber that comes into contact with the surfaces of the developing rollers 19Y, 19M, 19C, and 19K corresponding thereto, respectively, and are used to scrape off and remove developers remaining on the developing rollers 19Y, 19M, 19C, and 19K. Moreover, the developing-roller-cleaner collected-liquid storing units 22Y, 22M, 22C, and 22K respectively include containers such as tanks that store the developers scraped off from the developing rollers 19Y, 19M, 19C, and 19K by the developing roller cleaners 21Y, 21M, 21C, and 21K.

Moreover, the image forming apparatus 1 includes developer supplying devices 30Y, 30M, 30C, and 30K that supply the liquid developers 23Y, 23M, 23C, and 23K to the developer containers 24Y, 24M, 24C, and 24K. The developer supplying devices 30Y, 30M, 30C, and 30K respectively include toner tanks 31Y, 31M, 31C, and 31K, carrier tanks 32Y, 32M, 32C, and 32K, and agitating devices 33Y, 33M, 33C, and 33K.

In the toner tanks 31Y, 31M, 31C, and 31K, high-density liquid toners 34Y, 34M, 34C, and 34K containing solid content toners are stored, respectively. In the carrier tanks 32Y, 32M, 32C, and 32K, liquid carriers (carrier oils) 35Y, 35M, 35C, and 35K are stored, respectively. Predetermined amounts of the high-density liquid toners 34Y, 34M, 34C, and 34K from the toner tanks 31Y, 31M, 31C, and 31K and predetermined amounts of the liquid carriers 35Y, 35M, 35C, and 35K from the carrier tanks 32Y, 32M, 32C, and 32K are supplied to the agitating devices 33Y, 33M, 33C, and 33K, respectively.

The agitating devices 33Y, 33M, 33C, and 33K respectively mix and agitate the high-density liquid toners 34Y, 34M, 34C, and 34K and the liquid carriers 35Y, 35M, 35C, and 35K supplied thereto and prepare the liquid developers 23Y, 23M, 23C, and 23K used in the developing devices 5Y, 5M, 5C, and 5K. The liquid developers 23Y, 23M, 23C, and 23K prepared by the agitating devices 33Y, 33M, 33C, and 33K, respectively, are supplied to the developer containers 24Y, 24M, 24C, and 24K, respectively.

The photosensitive squeezing devices 6Y, 6M, 6C, and 6K respectively include squeeze rollers 36Y, 36M, 3C, and 36K, squeeze roller cleaners 37Y, 37M, 37C, and 37K, and squeeze-roller-cleaner collected-liquid storing containers 38Y, 38M, 38C, and 38K. The squeeze rollers 36Y, 36M, 36C, and 36K are respectively set further on downstream sides in the rotating direction of the photosensitive members 2Y, 2M, 2C, and 2K than contact sections (nip sections) of the photosensitive members 2Y, 2M, 2C, and 2K and the developing rollers 19Y, 19M, 19C, and 19K. The squeeze rollers 36Y, 36M, 36C, and 36K are respectively rotated in directions (counterclockwise in FIG. 1) opposite to the rotating directions of the photosensitive members 2Y, 2M, 2C, and 2K and removes the liquid carriers 35Y, 35M, 35C, and 35K on the photosensitive members 2Y, 2M, 2C, and 2K.

All the squeeze rollers 36Y, 36M, 36C, and 36K are preferably elastic rollers in which elastic members of conductive urethane rubber or the like and fluorine resin surface layers are arranged on the surfaces of core bars. All the squeeze roller cleaners 37Y, 37M, 37C, and 37K are made of an elastic member such as rubber, brought into contact with the surfaces of the squeeze rollers 36Y, 36M, 36C, and 36K corresponding thereto, respectively, and scrape off and remove the liquid carriers 35Y, 35M, 35C, and 35K remaining on the squeeze rollers 36Y, 36M, 36C, and 36K. The squeeze-roller-cleaner collected-liquid storing containers 38Y, 38M, 38C, and 38K are respectively containers such as tanks that store developers scraped off by the squeeze roller cleaners 37Y, 37M, 37C, and 37K corresponding thereto, respectively.

The primary transfer devices 7Y, 7M, 7C, and 7K respectively include backup rollers 39Y, 39M, 39C, and 39K for primary transfer that bring the intermediate transfer belt 10 into contact with the photosensitive members 2Y, 2M, 2C, and 2K. The backup rollers 39Y, 39M, 39C, and 39K are respectively applied with a voltage of about −200 V having polarity opposite to the charging polarity of the toner particles and primarily transfer toner images (liquid developer images) of the respective colors on the photosensitive members 2Y, 2M, 2C, and 2K onto the intermediate transfer belt 10.

The charge removing devices 8Y, 8M, 8C, and 8K respectively remove charges remaining on the photosensitive members 2Y, 2M, 2C, and 2K after the primary transfer.

The intermediate-transfer-belt squeezing devices 15Y, 15M, 15C, and 15K respectively include intermediate transfer belt squeeze rollers 40Y, 40M, 40C, and 40K, intermediate transfer belt squeeze roller cleaners 41Y, 41M, 41C, and 41K, and intermediate-transfer-belt-squeeze-roller-cleaner collected-liquid containers 42Y, 42M, 42C, and 42K. The intermediate transfer belt squeeze rollers 40Y, 40M, 40C, and 40K respectively collect the liquid carriers 35Y, 35M, 35C, and 35K of the colors corresponding thereto on the intermediate transfer belt 10. The intermediate transfer belt squeeze roller cleaners 41Y, 41M, 41C, and 41K respectively scrape off the collected liquid carriers 35Y, 35M, 35C, and 35K on the intermediate transfer belt squeeze rollers 40Y, 40M, 40C, and 40K. Like the squeeze roller cleaners 37Y, 37M, 37C, and 37K, the intermediate transfer belt squeeze roller cleaners 41Y, 41M, 41C, and 41K are respectively made of the elastic member such as rubber. The intermediate-transfer-belt-squeeze-roller-cleaner collected-liquid storing containers 42Y, 42C, 42M, and 42K respectively collect and store the liquid carriers 35Y, 35M, 35C, and 35K scraped off by the intermediate transfer belt squeeze roller cleaners 41Y, 41M, 41C, and 41K.

The secondary transfer device 16 includes a pair of secondary transfer rollers arranged a predetermined space apart from each other along a recording material moving direction. The secondary transfer roller arranged on an upstream side in the recording material moving direction of the pair of secondary transfer rollers is an upstream-side secondary transfer roller 43. The upstream-side secondary transfer roller 43 can be brought into press contact with the belt driving roller 11 via the intermediate transfer belt 10. The secondary transfer roller arranged on a downstream side in the recording material moving direction of the pair of secondary transfer rollers is a downstream-side secondary transfer roller 44. The downstream-side secondary transfer roller 44 can be brought into press contact with the driven roller 12 via the intermediate transfer belt 10. The upstream-side and downstream-side secondary transfer rollers 43 and 44 respectively bring the recording material into contact with the intermediate transfer belt 10 laid over the belt driving roller 11 and the driven roller 12 and secondarily transfer a color toner image (liquid developer image), which is obtained by combining the toner images of the respective colors, on the intermediate transfer belt 10 onto the recording material.

In that case, the belt driving roller 11 and the driven roller 12 also function as backup rollers for the secondary transfer rollers 43 and 44 during the secondary transfer. In other words, the belt driving roller 11 is also used as an upstream-side backup roller arranged further on the upstream side in the recording material moving direction than the driven roller 12 in the secondary transfer device 16. The driven roller 12 is also used as a downstream-side backup roller arranged further on the downstream side in the recording material moving direction than the belt driving roller 11 in the secondary transfer device 16.

During the secondary transfer, a load for bringing the upstream-side secondary transfer roller 43 into press contact with the belt driving roller 11 is set larger than a load for bringing the downstream-side secondary transfer roller 44 into press contact with the driven roller 12.

Therefore, the recording material conveyed to the secondary transfer device 16 is closely attached to the intermediate transfer belt 10 in a predetermined moving areas of the recording material from a press-contact start position (a nip start position) between the upstream-side secondary transfer roller 43 and the belt driving roller 11 to a press-contact end position (a nip end position) between the downstream-side secondary transfer roller 44 and the driven roller 12. Consequently, the full-color toner image on the intermediate transfer belt 10 is secondarily transferred onto the recording medium, which is closely attached to the intermediate transfer belt 10, for a predetermined time. As a result, satisfactory secondary transfer is performed.

The hardness of at least a surface layer section of the upstream-side secondary transfer roller 43 is set smaller (softer) than the hardness of at least a surface layer section of the belt driving roller 11. Therefore, as shown in FIG. 2, when the upstream-side secondary transfer roller 43 is brought into press contact with the belt driving roller 11 via the intermediate transfer belt 10 during the secondary transfer, a press-contact section (a nip section) of the upstream-side secondary transfer roller 43 is slightly recessed in an arc shape.

On the other hand, a diameter of the downstream-side secondary transfer roller 44 is set smaller than a diameter of the driven roller 12. The hardness of at least a surface layer section of the downstream-side secondary transfer roller 44 is set larger (harder) than the hardness of at least a surface layer section of the driven roller 12. Therefore, as shown in FIG. 2, when the downstream-side secondary transfer roller 44 is brought into press contact with the driven roller 12 via the intermediate transfer belt 10 during the secondary transfer, a press-contact section (a nip section) of the driven roller 12 is slightly recessed in an arc shape.

Consequently, a sheet-like recording material is effectively closely attached in the predetermined moving area of the recording material described above by the intermediate transfer belt 10 and the secondary transfer is effectively performed. The sheet-like recording material is easily peeled off from the intermediate transfer belt 10 after passing through a press-contact position between the downstream-side secondary transfer roller 44 and the driven roller 12. In that case, since the respective recesses of the upstream-side secondary transfer roller 43 and the driven roller 12 are relatively small, the recording material only slightly bends in the press-contact positions of the respective rollers. Therefore, passing properties of the recording material in the respective press-contact positions are satisfactorily maintained.

The secondary transfer device 16 includes secondary transfer roller cleaners 45 and 46 and secondary-transfer-roller-cleaner collected-liquid storing containers 47 and 48 for the pair of secondary transfer rollers 43 and 44, respectively. Like the squeeze roller cleaners 37Y, 37M, 37C, and 37K, both the secondary transfer roller cleaners 45 and 46 are made of the elastic member such as rubber. The secondary transfer roller cleaners 45 and 46 are respectively brought into contact with the secondary transfer rollers 43 and 44 and scrape off and remove developers remaining on the surfaces of the secondary transfer rollers 43 and 44 after the secondary transfer. The secondary-transfer-roller-cleaner collected-liquid storing containers 47 and 48 respectively collect and store the developers scraped off from the secondary transfer rollers 43 and 44 by the secondary transfer roller cleaners 45 and 46.

The intermediate-transfer-belt cleaning device 17 includes an intermediate transfer belt cleaner 49 and an intermediate-transfer-belt-cleaner collected-liquid storing container 50. The intermediate transfer belt cleaner 49 is brought into contact with the intermediate transfer belt 10 and scrapes off and removes a developer remaining on the surface of the intermediate transfer belt 10 after the secondary transfer. In that case, the driven roller 13 also functions as a backup roller during cleaning of the intermediate transfer belt 10. The intermediate transfer belt cleaner 49 is made of the elastic member such as rubber. The intermediate-transfer-belt-cleaner collected-liquid storing container 50 collects and stores the developer scraped off from the intermediate transfer belt 10 by the intermediate transfer belt cleaner 49.

In the image forming apparatus 1 of this example configured as described above, when an image forming operation is started, the photosensitive members 2Y, 2M, 2C, and 2K are uniformly charged by the charging devices 3Y, 3M, 3C, and 3K, respectively. Subsequently, electrostatic latent images of the respectively colors are formed on the photosensitive members 2Y, 2M, 2C, and 2K by the exposing devices 4Y, 4M, 4C, and 4K, respectively.

In the developing device 5Y for yellow Y, the liquid developer 23Y of yellow Y is pumped up to the anilox roller 26Y by the developer pumping roller 25Y. A proper amount of the liquid developer 23Y adhering to the anilox roller 26Y is caused to adhere in the groove of the anilox roller 26Y by the developer regulating blade 27Y. The liquid developer 23Y in the groove of the anilox roller 26Y is supplied to the developing roller 19Y. Further, the liquid developer 23Y on the developing roller 19Y is pressed against the developing roller 19Y in non-contact compaction by the compaction roller 20Y. In this state, the liquid developer 23Y on the developing roller 19Y is carried in a direction of the photosensitive member 2Y according to the rotation of the developing roller 19Y.

The carrier 35Y remaining on the compaction roller 20Y after the non-contact compassion by the compaction roller 20Y is finished is removed from the compaction roller 20Y by the compaction roller cleaner blade 28Y.

The electrostatic latent image formed on the photosensitive member 2Y for yellow Y is developed with the liquid developer 23Y of yellow Y in the developing device 5Y and a liquid developer image of yellow Y is formed on the photosensitive member 2Y. The developer remaining on the developing roller 19Y after the development is finished is removed from the developing roller 19Y by the developing roller cleaner 21Y. The liquid developer image of yellow Y on the photosensitive member 2Y is changed to a toner image of yellow Y after the liquid carrier 35Y on the photosensitive member 2Y is collected by the squeeze roller 36Y. The toner image of yellow Y is transferred onto the intermediate transfer belt 10 by the primary transfer device 7Y. The toner image of yellow Y on the intermediate transfer belt 10 is carried in a direction of the primary transfer device 7M for magenta M while the liquid carrier 35Y on the intermediate transfer belt 10 is collected by the intermediate transfer belt squeeze roller 40Y.

Subsequently, in the developing device 5M, the electrostatic latent image formed on the photosensitive member 2M for magenta M is developed with the liquid developer of magenta M carried in the same manner as the liquid developer of yellow Y and a liquid developer image of magenta M is formed on the photosensitive member 2M. At this point, the carrier 35M remaining on the compaction roller 20M after the non-contact compaction by the compaction roller 20M is finished is removed from the compaction roller 20M by the compaction roller cleaner blade 28M. The developer remaining on the developing roller 19M after the development is finished is removed from the developing roller 19M by the developing roller cleaner 21M.

The liquid developer image of magenta M on the photosensitive member 2M is changed to a toner image of magenta M after the liquid carrier 35M on the photosensitive member 2M is collected by the squeeze roller 36M. The toner image of magenta M is superimposed on the toner image of yellow Y and transferred onto the intermediate transfer belt 10 by the primary transfer device 7M. Similarly, the superimposed toner images of yellow Y and magenta M are carried in a direction of the primary transfer device 7C for cyan C while the liquid carrier 35M on the intermediate transfer belt 10 is collected by the intermediate transfer belt squeeze roller 40M. Similarly, a toner image of cyan and toner image of black are sequentially superimposed and transferred onto the intermediate transfer belt 10 and a full-color toner image is formed on the intermediate transfer belt 10.

Subsequently, the color toner image on the intermediate transfer belt 10 is secondarily transferred onto a transfer surface of a recording material such as paper by the secondary transfer device 16. At this point, the recording material conveyed to the secondary transfer device 16 is closely attached to the intermediate transfer belt 10 in a predetermined moving area of the recording material from a press-contact start position (a nip start position) between the belt driving roller 11 and the upstream-side secondary transfer roller 43 to a press-contact end position (a nip end position) between the driven roller 12 and the downstream-side secondary transfer roller 44. In other words, the recording material is also closely attached to the intermediate transfer belt 10 when the intermediate transfer belt 10 is not in a nip position between nip positions on the upstream and downstream sides. Consequently, the full-color toner image on the intermediate transfer belt 10 is secondarily transferred onto the recording material, which is closely attached to the intermediate transfer belt 10, for a predetermined time. Therefore, satisfactory secondary transfer is performed.

Moreover, since the upstream-side secondary transfer roller 43 is recessed in the nip position by the press contact with the belt driving roller 11, the recording material having passed through the nip position is urged in a direction of the intermediate transfer belt 10. Therefore, the recording material having passed through the nip position is closely attached to the intermediate transfer belt 10 more effectively. Consequently, more satisfactory secondary transfer is performed. Furthermore, the press-contact force for bringing the upstream-side secondary transfer roller 43 into press contact with the belt driving roller 11 is larger than the press-contact force for bringing the downstream-side secondary transfer roller 43 into press contact with the driven roller 12. This makes it difficult to peel off the recording material from the intermediate transfer belt 10 between both the press-contact positions (nip positions). Therefore, still more satisfactory secondary transfer is performed.

A diameter of the downstream-side secondary transfer roller 44 is set smaller than a diameter of the driven roller 12. The driven roller 12 is recessed in the nip position by press contact with the downstream-side secondary transfer roller 44 as described above. The recording material having passed through the nip position is urged in a direction separating from the intermediate transfer belt 10. Consequently, the secondary transfer onto the recording material is more satisfactorily performed and the recording material is easily peeled off from the intermediate transfer belt 10 after passing through the press-contact position between the downstream-side secondary transfer roller 44 and the driven roller 12.

After the secondary transfer, the liquid developers remaining on the downstream-side secondary transfer rollers 43 and 44, respectively, are scraped off and removed from the rollers 43 and 44 by the secondary transfer roller cleaners 45 and 46, respectively. The removed liquid developers are collected and stored in the secondary-transfer-roller-cleaner collected-liquid storing containers 47 and 48, respectively.

The color toner image transferred onto the recording material is fixed by a not-shown fixing device in the same manner as in the past. The recording material on which a full-color fixed image is formed is conveyed to a paper discharge tray and a color image forming operation is finished.

In the exposing device 4 of this example, as shown in FIG. 2, the light-emitting-element supporting member 4*d* is supported at both the ends thereof by two first and second exposure-position adjusting devices 52 and 53 (equivalent to the exposure-position adjusting mechanism of the invention) The first and second exposure-position adjusting devices 52 and 53 have the same configuration and supported by not-shown device main bodies.

Figure 5:
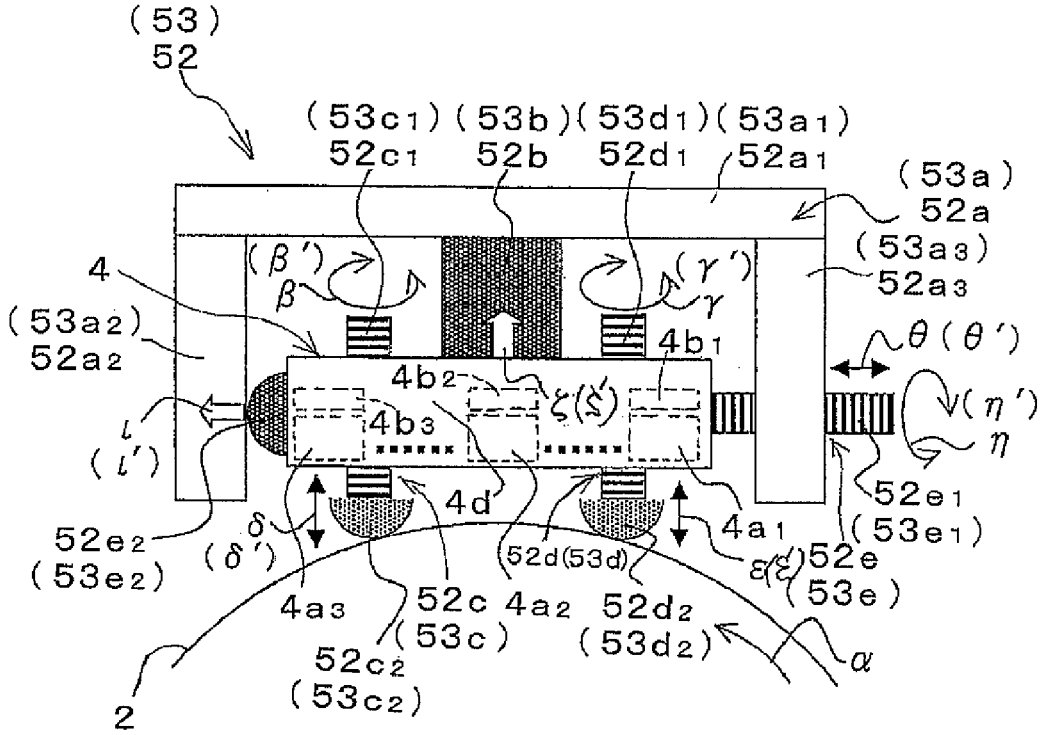
FIG. 5 is a sectional view schematically showing an exposure-position adjusting device in this example and taken along line V-V in FIG. 2.

FIG. 5 is a sectional view schematically showing an exposure-position adjusting device and taken along line V-V in FIG. 2. In FIG. 5, one first exposure-position adjusting device 52 is shown The other second exposure-position adjusting device 53 has completely the same configuration as the first exposure-position adjusting device 52. Therefore, components of the first exposure-position adjusting device 52 are denoted by parenthesized reference numerals and signs and are not shown in the figure. In the following explanation of the specification, the reference numerals and signs of the components of the second exposure-position adjusting device 53 are not parenthesized.

As shown in FIG. 5, the first and second exposure-position adjusting devices 52 and 53 respectively include lens arrays $\mathbf{4}a_1$, $\mathbf{4}a_2$, and $\mathbf{4}a_3$ and light-emitting elements $\mathbf{4}b_1$, $\mathbf{4}b_2$, and $\mathbf{4}b_3$ provided in parallel in three rows in a width direction of the light-emitting-element supporting member 4*d*. The first and second exposure-position adjusting devices 52 and 53 respectively includes C-shaped exposing-device supporting members 52*a* and 53*a*, elastic back plates 52*b* and 53*b*, and first to third position adjusting mechanisms 52*c* and 53*c*, 52*d* and 53*d*, and 52*e* and 53*e*. The first and second position adjusting mechanisms 52*c* and 53*c* and 52*d* and 53*d* are configured completely the same.

The exposing-device supporting members 52*a* and 53*a* are formed in a C shape in side view including upper bottoms $\mathbf{52}a_1$ and $\mathbf{53}a_1$ and sidewalls $\mathbf{52}a_2$ and $\mathbf{53}a_2$ and $\mathbf{52}a_3$ and $\mathbf{53}a_3$ vertically provided at both side edges of the upper bottoms $\mathbf{52}a_1$ and $\mathbf{53}a_1$. The exposing-device supporting members 52*a* and 53*a* are extended in the sub-scanning direction and fixed to the apparatus main body.

The elastic back plates 52*b* and 53*b* are made of the elastic member such as rubber and interposed between the exposing-device supporting members 52*a* and 53*a* and the light-emitting-element supporting member 4*d* in a center position in a width direction of the exposing-device supporting members 52*a* and 53*a* (the sub-scanning direction of the photosensitive member 2). The light-emitting-element supporting member 4*d* is elastically supported in the center position in the width direction of the exposing-device supporting members 52*a* and 53*a* via the elastic back plates 52*b* and 53*b*.

The first position adjusting mechanisms 52*c* and 53*c* include first position adjusting screws $\mathbf{52}c_1$ and $\mathbf{53}c_1$, respectively. The first position adjusting screws $\mathbf{52}c_1$ and $\mathbf{53}c_1$ are screwed to one end side of the light-emitting-element supporting member 4*d* and pierce through the light-emitting-element supporting member 4*d* in an up to down direction in FIG. 5. At lower ends of the first position adjusting screws 52$c_1$ and 53$c_1$, lubricating members 52$c_2$ and 53$c_2$ of a semispherical shape made of resin or the like having lubricity are fixed, respectively. Spherical surface sections of the lubricating members 52$c_2$ and 53$c_2$ are set in contact with the outer peripheral surface of the non-image section of the photosensitive member 2.

The second position adjusting mechanisms 52*d* and 53*d* include second position adjusting screws 52$d_1$ and 53$d_1$, respectively. The second position adjusting screws 52$d_1$ and 53*d*, are screwed in positions line-symmetrical with respect to a center line in the up to down direction of the elastic back plate 52*b* and 53*b* on the other end side of the light-emitting-element supporting member 4*d* and pierce through the light-emitting-element supporting member 4*d* in the up to down direction in FIG. 5. At lower ends of the second position adjusting screws 52$d_1$ and 53$d_1$, lubricating members 52$d_2$ and 53$d_2$ of a semispherical shape made of resin or the like having lubricity are fixed, respectively. Spherical surface sections of the lubricating members 52$d_2$ and 53$d_2$ are set in contact with the outer peripheral surface of the non-image section of the photosensitive member 2. Therefore, both ends in longer directions of the lens arrays 4$a_1$, 4$a_2$, and 4$a_3$ and the light-emitting elements 4$b_1$, 4$b_2$, and 4$b_3$ are respectively supported at four points on the outer peripheral surface of the non-image section of the photosensitive member 2.

The third position adjusting mechanisms 52*e* and 53*e* include third position adjusting screws 52$e_1$ and 53$e_1$, respectively. The third position adjusting screws 52$e_1$ and 53$e_1$ pierce through one sidewalls 52$a_3$ and 53$a_3$ of the exposing-device supporting member 52*a* in a left to right direction in FIG. 5 (a direction orthogonal to the up to down direction and a longitudinal direction of the third position adjusting mechanisms 52*e* and 53*e*). Left ends of the third position adjusting screws 52$e_1$ and 53$e_1$ are set in contact with a side edge surface on one side of the light-emitting-element supporting member 4*d*. Elastic members 52$e_2$ and 53$e_2$ made of rubber are fixed to a side edge surface on the other side of the light-emitting-element supporting member 4*d*. The elastic members 52$e_2$ and 53$e_2$ are set in contact with the other sidewalls 52$a_2$ and 53$a_2$ of the exposing-device supporting members 52*a* and 53*a*.

The first and second position adjusting screws 52$c_1$ and 53$c_1$ and 52$d_1$ and 53$d_1$ are rotated in an arrow β, β' direction and an arrow γ, γ' direction, respectively. Then, the first and second position adjusting screws 52$c_1$ and 53$c_1$ and 52$d_1$ and 53$d_1$ relatively move in a direction of the photosensitive member 2 with respect to the light-emitting-element supporting member 4*d* or relatively move in a direction away from the photosensitive member 2. In that case, when the first and second position adjusting screws 52$c_1$ and 53$c_1$ and 52$d_1$ and 53$d_1$ are rotated, friction between the first and second position adjusting screws 52$c_1$ and 53$c_1$ and 52$d_1$ and 53$d_1$ and the photosensitive member 2 is reduced by the lubricating members 52$c_2$ and 53$c_2$ and 52$d_2$ and 53$d_2$. The exposing device 4 is moved in an arrow δ, δ' direction and an arrow ϵ, ϵ' direction with respect to the photosensitive member 2 by the relative movement of the first and second position adjusting screws 52$c_1$ and 53$c_1$ and 52$d_1$ and 53$d_1$ with respect to the light-emitting-element supporting member 4*d*. A distance between the photosensitive member 2 and the exposing device 4 is adjusted. In other words, positions of exposure on the photosensitive member 2 by the first to third light-emitting elements 4*b* are adjusted.

In that case, the first and second position adjusting screws 52$c_1$ and 53$c_1$ and 52$d_1$ and 53$d_1$ are relatively moved by the same amount in directions opposite to each other with respect to the light-emitting-element supporting member 4*d*. Then, light-emitting-element supporting member 4*d* rotates substantially around axes in the main scanning direction in center positions in the sub-scanning direction, which are exposure positions of the respective light-emitting elements 4*b*. In other words, the first and second position adjusting mechanisms 52*c* and 53*c* and 52*d* and 53*d* configure a rotary exposure-position adjusting unit that rotates the lens arrays 4*a* and the light-emitting elements 4*b* substantially around the axes and adjusts the exposure positions.

The first and second position adjusting screws 52$c_1$ and 53$c_1$ and 52$d_1$ and 53$d_1$ are respectively brought into press contact with the photosensitive member 2 via the lubricating members 52$c_2$ and 53$c_2$ and 52$d_2$ and 53$d_2$. The reaction of the press-contact force, i.e., the force of the photosensitive member 2 pressing the light-emitting-element supporting member 4*d* via the first and second position adjusting screws 52$c_1$ and 53$c_1$ and 52$d_1$ and 53$d_1$ is transmitted in an arrow ζ, ζ' direction to the elastic members 52*b* and 53*b*. Therefore, the force of the photosensitive member 2 pressing the light-emitting-element supporting member 4*d* is absorbed by the elastic deformation of the elastic members 52*b* and 53*b*. Consequently, even if rotation irregularity occurs in the photosensitive member 2 and the force of the photosensitive member 2 pressing the light-emitting-element supporting member 4*d* fluctuates, the fluctuation in the force is absorbed by the elastic members 52*b* and 53*b*. Therefore, positional deviation in the arrow δ, δ' direction and the arrow ϵ, ϵ' direction of the light-emitting elements 4*b* and the lens arrays 4*a* of the exposing device 4 is suppressed.

On the other hand, the third position adjusting screws 52$e_1$ and 53$e_1$ are rotated in an arrow η, η' direction to be relatively moved in a direction of the exposing device 4 with respect to the sidewalls 52$a_3$ and 53$a_3$ and relatively moved in a direction away from the exposing device 4. Consequently, the exposing device 4 (i.e., positions of the lens arrays 4*a* and the light-emitting elements 4*b*) moves in the same direction as a moving direction of the third position adjusting screws 52$e_1$ and 53$e_1$ and exposure positions in an arrow θ, θ' direction, which is the sub-scanning direction, are adjusted. In other words, the third position adjusting mechanisms 52*e* and 53*e* configure a sub-scanning-direction exposure-position adjusting mechanism (equivalent to the second direction exposure-position adjusting unit of the invention) that moves the lens arrays 4*a* and the light-emitting elements 4*b* in the arrow θ, θ' direction to adjust exposure positions in the sub-scanning direction.

The elastic members 52$e_2$ and 53$e_2$ fixed to the light-emitting-element supporting member 4*d* of the exposing device 4 are brought into contact with the sidewalls 52$a_2$ and 53$a_2$ of the exposing-device supporting members 52*a* and 53*a*. Consequently, the force from the third position adjusting screws 52$e_1$ and 53$e_1$ is transmitted in an arrow ∫, ∫' direction to the elastic members 52$e_2$ and 53$e_2$ via the light-emitting-element supporting member 4*d*. Moreover, according to the rotation in the arrow α direction of the photosensitive member 2, the rotation force is also transmitted in the arrow ∫, ∫' direction to the elastic members 52$e_2$ and 53$e_2$ via the lubricating members 52$c_2$ and 53$c_2$ and 52$d_2$ and 53$d_2$, the first and second position adjusting screws 52$c_1$ and 53$c_1$ and 52$d_1$ and 53$d_1$, and the light-emitting-element supporting member 4*d*. Therefore, the force of the rotation of the photosensitive member 2 pressing the light-emitting-element supporting member 4*d* is absorbed by the elastic deformation of the elastic members 52$e_2$ and 53$e_2$. Consequently, even if rotation irregularity occurs in the photosensitive member 2 and the force of the rotation of the photosensitive member 2 pressing the light-emitting-element supporting member 4*d* fluctuates, the fluctuation in the force is absorbed by the elastic members 52$e_2$ and 53$e_2$. Therefore, positional deviation in the arrow θ, θ' direction of the light-emitting elements 4*b* and the lens arrays 4*a* of the exposing device 4 is suppressed.

An example of an exposure-position adjusting procedure (method) in the lens arrays 4*a* and the light-emitting elements 4*b* by the first to third position adjusting mechanisms 52*c* and 53*c*, 52*d* and 53*d*, and 52*e* and 53*e* is explained. Among the light-emitting elements 4*b* in the three rows, first, an exposure position of the light-emitting element 4$b_2$ in the center is adjusted.

Explanation of an Exposure-Position Adjusting Procedure for the Light-Emitting Element 4$b_2$ in the Center In an exposure-position adjusting procedure for the light-emitting element 4$b_2$ in the center, first, as shown in Table 1, lower limit values and upper limit values of adjustment amounts in respective directions δ, ϵ, θ, δ', ϵ', and θ' are set. In Table 1, the arrows of the respective directions δ, ϵ, θ, δ', ϵ', and θ' in FIG. 2 indicate positive directions

TABLE 1

| Direction | Adjustment amount lower limit value | Adjustment amount upper limit value |
|---|---|---|
| δ | −dδ | +dδ |
| ϵ | −dϵ | +dϵ |
| θ | −dθ | +dθ |
| δ' | −dδ' | +dδ' |
| ϵ' | −dϵ' | +dϵ' |
| θ' | −dθ' | +dθ' |

Directions of Arrows in FIG. 2 are Positive Directions

As shown in Table 1, the adjustment amount lower limit value in the δ direction of the first position adjusting mechanism 52*c* is set to −dδ, the adjustment amount lower limit value in the ϵ direction of the first position adjusting mechanism 52*c* is set to −dϵ, and the adjustment amount lower limit value in the θ direction of the first position adjusting mechanism 52*c* is set to −dθ. The adjustment amount upper limit value in the δ direction of the first position adjusting mechanism 52*c* is set to +dδ, the adjustment amount upper limit value in the ϵ direction of the first position adjusting mechanism 52*c* is set to +dϵ, and the adjustment amount upper limit value in the θ direction of the first position adjusting mechanism 52*c* is set to +dθ. On the other hand, the adjustment amount lower limit value in the δ' direction of the second position adjusting mechanism 53*c* is set to −dδ', the adjustment amount lower limit value in the ϵ' direction of the second position adjusting mechanism 53*c* is set to −dϵ', and the adjustment amount lower limit value in the θ' direction of the second position adjusting mechanism 53*c* is set to −dθ'. The adjustment amount upper limit value in the δ' direction of the second position adjusting mechanism 53*c* is set to +dδ', the adjustment amount upper limit value in the ϵ' direction of the second position adjusting mechanism 53*c* is set to +dϵ', and the adjustment amount upper limit value in the θ' direction of the second position adjusting mechanism 53*c* is set to +dθ'. The adjustment amount lower limit values and the adjustment amount upper limit values vary depending on a shape, a specification, a condition of use, and the like of an image forming apparatus. Therefore, for generalization, the adjustment amount lower limit values and the adjustment amount upper limit values are indicated by the signs dθ, dϵ, and the like.

As shown in Table 2, as exposure position adjustment patterns of an exposure position adjustment image initially printed to adjust the exposure position of the light-emitting element 4$b_2$ in the center, four patterns A, B, C, and D are set in this example. The patterns A, B, C, and D are combinations of various different initial positions in the δ, ϵ, θ, δ', ϵ', and θ' directions. The combinations of the initial positions are not limited to four. Arbitrary numbers of combinations are possible. Initial positions in the respective directions are not limited to the positions shown in Table 2. The initial positions can be set arbitrarily. In the following explanation, for convenience of explanation, the patterns are explained according to items described in Table 2.

TABLE 2

| Pattern | Direction | Initial position |
|---|---|---|
| Pattern A | δ | +dδ |
| | ϵ | +dϵ |
| | θ | +dθ |
| | δ' | −dδ' |
| | ϵ' | −dϵ' |
| | θ' | −dθ' |
| Pattern B | δ | +dδ |
| | ϵ | +dϵ |
| | θ | −dθ |
| | δ' | −dδ' |
| | ϵ' | −dϵ' |
| | θ' | +dθ' |
| Pattern C | δ | −dδ |
| | ϵ | −dϵ |
| | θ | +dθ |
| | δ' | +dδ' |
| | ϵ' | +dϵ' |
| | θ' | −dθ' |
| Pattern D | δ | −dδ |
| | ϵ | −dϵ |
| | θ | −dθ |
| | δ' | +dδ' |
| | ϵ' | +dϵ' |
| | θ' | +dθ' |

Directions of Arrows in FIG. 2 are Positive Directions

First, the pattern A is explained. As shown in Table 2, initial positions in the δ, ϵ, and θ of the first position adjusting mechanism 52*c* are respectively set in positions of +dδ, +dϵ, and +dθ, which are the adjustment amount upper limit values in the directions. On the other hand, initial positions in the δ', ϵ', and θ' directions of the second position adjusting mechanism 53*c* are respectively set in positions of −dδ, −dϵ, and −dθ, which are the adjustment amount lower limit values in the directions.

The pattern B is explained. As shown in Table 2, initial positions in the δ and δ directions of the first position adjusting mechanism 52*c* are respectively set in positions of +dδ and +dϵ, which are the adjustment amount upper limit values in the directions. An initial position in the θ direction of the first position adjusting mechanism 52*c* is set in a position of −dθ, which is the adjustment amount lower limit value in the direction. On the other hand, initial positions in the δ' and ϵ' directions of the second position adjusting mechanism 53*c* are respectively set in positions of −dδ and −dϵ, which are the adjustment amount lower limit value in the directions. An initial value in the θ direction of the second position adjusting mechanism 53*c* is set in a position of +dθ', which is the adjustment amount upper limit value in the direction.

The pattern C is explained. As shown in Table 2, initial positions in the δ and ϵ directions of the first position adjusting mechanism 52*c* are respectively set in positions of −dδ and −dϵ, which are the adjustment amount lower limit values in the directions. An initial position in the θ direction of the first position adjusting mechanism 52*c* is set in a position of +dθ, which is the adjustment amount upper limit value in the direction. On the other hand, initial positions in the δ' and ϵ' directions of the second position adjusting mechanism 53*c* are respectively set in positions of +δ and +dϵ, which are the adjustment amount upper limit values in the directions. An initial value in the θ' direction of the second position adjusting mechanism 53*c* is set in a position of −dθ', which is the adjustment amount lower limit value in the direction.

The pattern D is explained. As shown in Table 2, initial positions in the δ, ϵ, and θ directions of the first position adjusting mechanism 52*c* are respectively set in positions of −dδ, −dϵ, and −dθ, which are the adjustment amount lower limit values in the directions. On the other hand, initial positions in the δ', ϵ', and θ' directions of the second position adjusting mechanism 53*c* are respectively set in positions of +dδ', +dϵ', and +dθ', which are the adjustment amount upper limit values in the directions.

Figure 6:
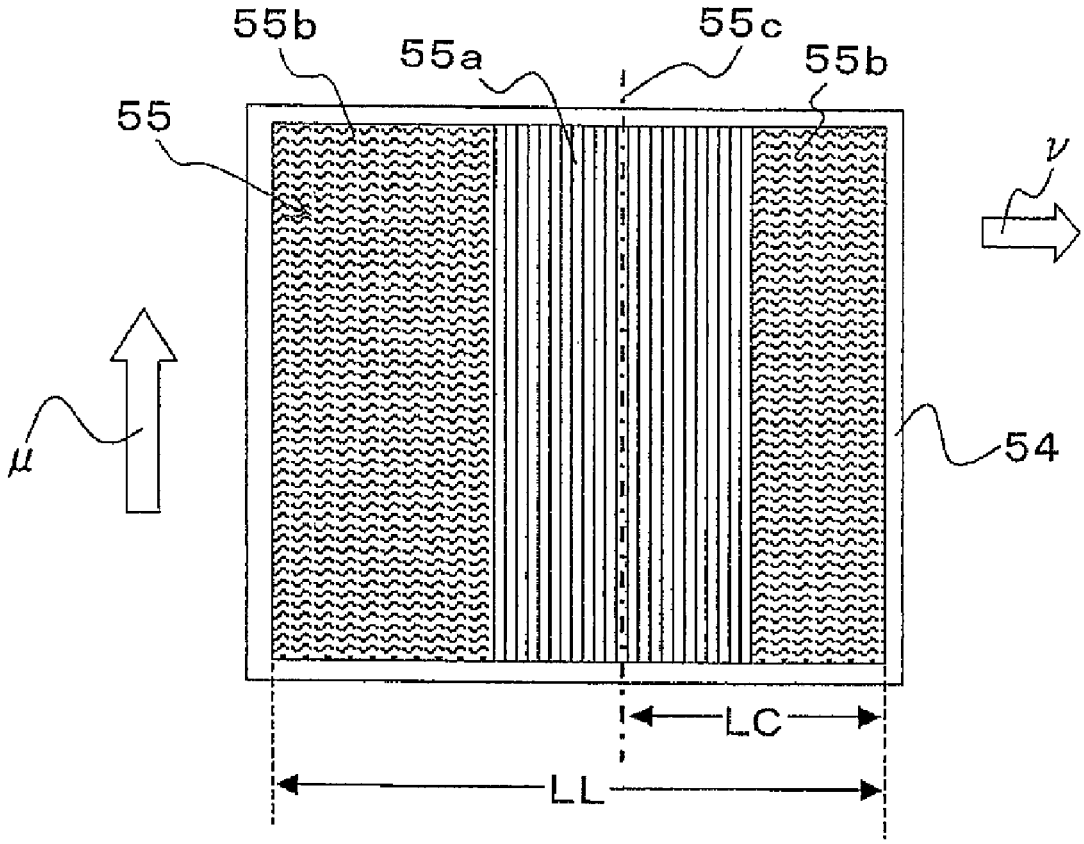
FIG. 6 is a diagram schematically showing an exposure position adjustment image initially printed.

FIG. 6 is a diagram schematically showing an exposure position adjustment image initially printed. In the exposure position adjustment image shown in FIG. 6, exposure position adjustment images in the patterns A, B, C, and D are generalized.

As shown in FIG. 6, in a state in which initial positions are set in respective directions of the first and second position adjusting mechanisms 52*c* and 53*c*, an exposure position adjustment image 55 is printed on a recording material (paper) 54. The exposure position adjustment image (an exposed section) 55 has a range 55*a* of a focused exposure position adjustment image and a range 55*b* of a defocused exposure position adjustment image.

Figure 11:
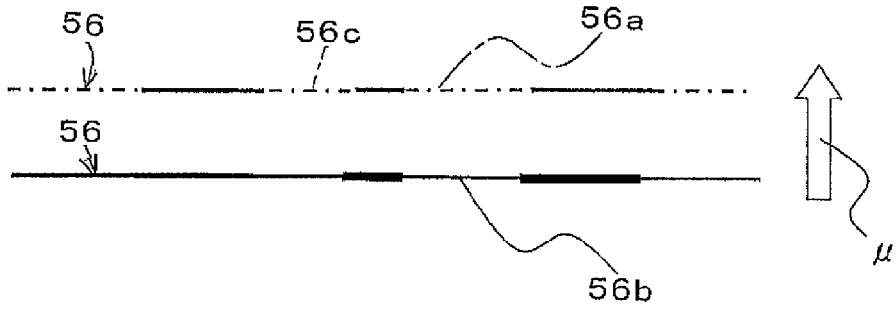
FIG. 11 is a diagram showing a horizontal line image in a first comparative example.

When the range 55*b* of the defocused exposure position adjustment image is observed by a microscope, in this range 55*b*, at least one of a state in which a one-dot width vertical line is disordered, a state in which the one-dot width vertical line is blurred, and a state in which print cannot be performed because a latent image is too shallow and cannot be developed is present as shown in FIG. 11 referred to later. When the range 55*a* of the focused exposure position adjustment image is observed by the microscope, in this range 55*a*, the one-dot width vertical line appears straight. Therefore, it is judged whether an exposure position adjustment image is focused or defocused by observing these states of the exposure position adjustment image with the microscope.

In FIG. 6, 55*c* represents the center in a width direction of the range of the focused exposure position adjustment image, LL represents maximum width of the exposure position adjustment image (the exposed section), LC represents a distance between the center 55*c* of the focused range and an end on the first exposure-position adjusting device 52 of the exposure position adjustment image (the exposed section), and μ represents a direction on the recording material 54 associated with the rotating direction of the photosensitive member 2, and ν represents a direction associated with the θ direction of the first exposure-position adjusting device 52.

In such an exposure position adjustment image (the exposed section), exposure adjustment positions at the time when a focused range of the light-emitting element $4b_2$ in the center is the maximum are shown in Table 3.

TABLE 3

| Pattern | Direction | Exposure adjustment positions at the time when a focused range is the maximum |
|---|---|---|
| Pattern A | δ | −dδ + (dδ + dδ') × LC/LL |
| | ϵ | −dϵ + (dϵ + dϵ') × LC/LL |
| | θ | −dθ + (dθ + dθ') × LC/LL |
| | δ' | +dδ' − (dδ + dδ') × (LL − LC)/LL |
| | ϵ' | +dϵ' − (dϵ + dϵ') × (LL − LC)/LL |
| | θ' | +dθ' − (dθ + dθ') × (LL − LC)/LL |
| Pattern B | δ | −dδ + (dδ + dδ') × LC/LL |
| | ϵ | −dϵ + (dϵ + dϵ') × LC/LL |
| | θ | +dθ − (dθ + dθ') × LC/LL |
| | δ' | +dδ' − (dδ + dδ') × (LL − LC)/LL |
| | ϵ' | +dϵ' − (dϵ + dϵ') × (LL − LC)/LL |
| | θ' | −dθ' + (dθ + dθ') × (LL − LC)/LL |
| Pattern C | δ | +dδ − (dδ + dδ') × LC/LL |
| | ϵ | +dϵ − (dϵ + dϵ') × LC/LL |
| | θ | −dθ + (dθ + dθ') × LC/LL |
| | δ' | −dδ' + (dδ + dδ') × (LL − LC)/LL |
| | ϵ' | −dϵ' + (dϵ + dϵ') × (LL − LC)/LL |
| | θ' | +dθ' − (dθ + dθ') × (LL − LC)/LL |
| Pattern D | δ | +dδ − (dδ + dδ') × LC/LL |
| | ϵ | +dϵ − (dϵ + dϵ') × LC/LL |
| | θ | +dθ + (dθ + dθ') × LC/LL |
| | δ' | −dδ' + (dδ + dδ') × (LL − LC)/LL |
| | ϵ' | −dϵ' + (dϵ + dϵ') × (LL − LC)/LL |
| | θ' | −dθ' − (dθ + dθ') × (LL − LC)/LL |

Directions of Arrows in FIG. 2 are Positive Directions

First, exposure adjustment positions at the time when a focused range in the pattern A is the maximum are explained. As shown in Table 3, an exposure adjustment position in the δ direction of the first position adjusting mechanism 52*c* is −dδ+(dδ+dδ')×LC/LL. An exposure adjustment position in the ϵ direction is −dϵ+(dϵ+dϵ')×LC/LL. An exposure adjustment position in the θ direction is −dθ+(dθ+dθ')×LC/LL. On the other hand, an exposure adjustment position in the δ' direction of the second position adjusting mechanism 53*c* is +dδ'−(dδ+dδ')×(LL−LC)/LL. An exposure adjustment position in the ϵ' direction is +dϵ'−(dϵ+dϵ')×(LL−LC)/LL. An exposure adjustment position in the θ' direction is +dθ'−(dθ+dθ')×(LL−LC)/LL.

Exposure adjustment positions at the time when a focused range in the pattern B is the maximum are explained. As shown in Table 3, an exposure adjustment position in the δ direction of the first position adjusting mechanism 52*c* is −dδ+(dδ+dδ')×LC/LL. An exposure adjustment position in the ϵ direction is −dϵ+(dϵ+dϵ')×LC/LL. An exposure adjustment position in the θ direction is +dθ−(dθ+dθ')×LC/LL. On the other hand, an exposure adjustment position in the δ' direction of the second position adjusting mechanism 53*c* is +dδ'−(dδ+dδ')×(LL−LC)/LL. An exposure adjustment position in the ϵ' direction is +dϵ'−(dϵ+dϵ')×(LL−LC)/LL. An exposure adjustment position in the θ' direction is −dθ'+(dθ+dθ')×(LL−LC)/LL.

Exposure adjustment positions at the time when a focused range in the pattern C is the maximum are explained. As shown in Table 3, an exposure adjustment position in the δ direction of the first position adjusting mechanism 52*c* is +dδ−(dδ+dδ')×LC/LL. An exposure adjustment position in the ϵ direction is +dϵ−(dϵ+dϵ')×LC/LL. An exposure adjustment position in the θ direction is −dθ+(dθ+dθ')×LC/LL. On the other hand, an exposure adjustment position in the δ' direction of the second position adjusting mechanism 53*c* is −dδ'+(dδ+dδ')×(LL−LC)/LL. An exposure adjustment position in the ϵ' direction is −dϵ'+(dϵ+dϵ')×(LL−LC)/LL. An exposure adjustment position in the θ' direction is +dθ'−(dθ+dθ')×(LL−LC)/LL.

Exposure adjustment positions at the time when a focused range in the pattern D is the maximum are explained. As shown in Table 3, an exposure adjustment position in the δ direction of the first position adjusting mechanism 52$c$ is $+d\delta-(d\delta+d\delta')\times LC/LL$. An exposure adjustment position in the $\epsilon$ direction is $+d\epsilon-(d\epsilon+d\epsilon')\times LC/LL$. An exposure adjustment position in the $\theta$ direction is $+d\theta+(d\theta+d\theta')\times LC/LL$. On the other hand, an exposure adjustment position in the $\delta'$ direction of the second position adjusting mechanism 53$c$ is $-d\delta'+(d\delta+d\delta')\times(LL-LC)/LL$. An exposure adjustment position in the $\epsilon'$ direction is $-d\epsilon'+(d\epsilon+d\epsilon')\times(LL-LC)/LL$. An exposure adjustment position in the $\theta'$ direction is $-d\theta'-(d\theta+d\theta')\times(LL-LC)/LL$.

Exposure adjustment positions in the respective directions of the first and second position adjusting mechanisms 52$c$ and 53$c$ are adjusted to the exposure adjustment positions at the time when the focused range of the light-emitting element 4$b_2$ in the center in the respective patterns A, B, C, and D is the maximum in this way. Consequently, an exposure position of the light-emitting element 4$b_2$ in the center is adjusted to be best focused. Then, exposure positions of the light-emitting elements 4$b_1$ and 4$b_3$ at both the ends are adjusted.

Explanation of an Exposure Position Adjustment Procedure for the Light-Emitting Elements 4$b_1$ and 4$b_3$ at Both the Ends In an exposure-position adjusting procedure for the light-emitting elements 4$b_1$ and 4$b_3$ at both the ends, as exposure position adjustment patterns of an exposure position adjustment image initially printed to adjust respective exposure positions of the light-emitting elements 4$b_1$ and 4$b_3$ at both the ends, two patterns E and F are set in this example as shown in Table 4. These patterns E and F are combinations of various different initial positions in the $\delta$, $\epsilon$, $\delta'$, and $\epsilon'$ directions. The combinations of the initial positions are not limited to two. Arbitrary numbers of combinations are possible. The initial positions in the respective directions are not limited to the positions shown in Table 4 and can be arbitrarily set. In the following explanation, for convenience of explanation, the patterns are explained according to items described in Table 4.

TABLE 4

| Pattern | Direction | Initial position |
|---|---|---|
| Pattern E | $\delta$ | $-\kappa$ |
| | $\epsilon$ | $+\kappa$ |
| | $\delta'$ | $+\lambda$ |
| | $\epsilon'$ | $-\lambda$ |
| Pattern | $\delta$ | $+\kappa$ |
| | $\epsilon$ | $-\kappa$ |
| | $\delta'$ | $-\lambda$ |
| | $\epsilon'$ | $+\lambda$ |

$\kappa \leqq$ smaller one of $d\delta$ and $d\epsilon$
$\lambda \leqq$ smaller one of $d\delta'$ and $d\epsilon'$ Directions of Arrows in FIG. 2 are Positive Directions First, the pattern E is explained. As shown in Table 4, initial positions in the $\delta$ and $\epsilon$ directions of the first position adjusting mechanism 52$c$ are set in $-\kappa$ and $+\kappa$. In other words, both the ends of the first position adjusting mechanism 52$c$ are initially moved by the same amount in opposite directions in the $\delta$ and $\epsilon$ directions, respectively. On the other hand, initial positions in the $\delta'$ and $\epsilon'$ directions of the second position adjusting mechanism 53$c$ are set in $+\lambda$ and $-\lambda$. In other words, similarly, both the ends of the second position adjusting mechanism 53$c$ are initially moved by the same amount in opposite directions in the $\delta'$ and $\epsilon'$ directions, respectively. $\kappa$ is equal to or smaller than smaller one of $d\delta$ and $d\delta'$ and $\lambda$ is equal to or smaller than smaller one of $d\delta$ and $d\delta'$.

The pattern F is explained. As shown in Table 4, initial positions in the $\delta$ and $\epsilon$ directions of the first position adjusting mechanism 52$c$ are set in $+\kappa$ and $-\kappa$. In other words, both the ends of the first position adjusting mechanism 52$c$ are initially moved by the same amount in opposite directions in the $\delta$ and $\epsilon$ directions, respectively. On the other hand, initial positions in the $\delta'$ and $\epsilon'$ directions of the second position adjusting mechanism 53$c$ are set in $-\lambda$ and $+\lambda$. In other words, similarly, both the ends of the second position adjusting mechanism 53$c$ are initially moved by the same amount in opposite directions in the $\delta'$ and $\epsilon'$ directions, respectively. $\kappa$ is equal to or smaller than smaller one of $d\delta$ and $d\delta'$ and $\lambda$ is equal to or smaller than smaller one of $d\delta$ and $d\delta'$.

When both the ends of the first and second position adjusting mechanisms 52$c$ and 53$c$ are initially moved by the same amount in the opposite directions, respectively, in the patterns E and F, the lens arrays 4$a$ and light-emitting elements 4$b$ rotate substantially around the axis in the main scanning direction passing through the exposure adjustment position of the light-emitting element 4$b_2$ in the center already adjusted. Consequently, the adjusted exposure adjustment position of the light-emitting element 4$b_2$ in the center is prevented from shifting. Since initial positions in the $\theta$ and $\theta'$ directions are not set in the patterns E and F, the exposure adjustment position of the light-emitting element 4$b_2$ in the center is also prevented from shifting.

Exposure adjustment positions at the time when focused ranges of the light-emitting elements 4$b_1$ and 4$b_3$ at both the ends are the maximum in such patterns E and F are shown in Table 5.

TABLE 5

| Pattern in which a focused range is the maximum | Direction | Adjustment position |
|---|---|---|
| Pattern E | $\delta$ | $-\kappa+(\kappa+\lambda)\times LC/LL$ |
| | $\epsilon$ | $+\kappa-(\kappa+\lambda)\times LC/LL$ |
| | $\delta'$ | $+\lambda-(\kappa+\lambda)\times(LL-LC)/LL$ |
| | $\epsilon'$ | $-\lambda+(\kappa+\lambda)\times(LL-LC)/LL$ |
| Pattern | $\delta$ | $+\kappa-(\kappa+\lambda)\times LC/LL$ |
| | $\epsilon$ | $-\kappa+(\kappa+\lambda)\times LC/LL$ |
| | $\delta'$ | $-\lambda+(\kappa+\lambda)\times(LL-LC)/LL$ |
| | $\epsilon'$ | $+\lambda-(\kappa+\lambda)\times(LL-LC)/LL$ |

Directions of Arrows in FIG. 2 are Positive Directions

First, exposure adjustment positions at the time when a focused range in the pattern E is the maximum is explained. As shown in Table 5, an exposure adjustment position in the $\delta$ direction of the first position adjusting mechanism 52$c$ is $-\kappa+(\kappa+\lambda)\times LC/LL$. An exposure adjustment position in the $\epsilon$ direction is $+\kappa-(\kappa+\lambda)\times LC/LL$. On the other hand, an exposure adjustment position in the $\delta'$ direction of the second position adjusting mechanism 53$c$ is $+\lambda-(\kappa+\lambda)\times(LL-LC)/LL$. An exposure adjustment position in the $\epsilon'$ direction is $-\lambda+(\kappa+\lambda)\times(LL-LC)/LL$. In the adjustment in this case, in the same manner as described above, the exposure adjustment position of the light-emitting element 4$b_2$ in the center already adjusted is prevented from shifting.

Exposure adjustment positions at the time when a focused range in the pattern F is the maximum is explained. As shown in Table 5, an exposure adjustment position in the $\delta$ direction of the first position adjusting mechanism 52$c$ is $+\kappa-(\kappa+\lambda)\times LC/LL$. An exposure adjustment position in the $\epsilon$ direction is $-\kappa+(\kappa+\lambda)\times LC/LL$. On the other hand, an exposure adjustment position in the $\delta'$ direction of the second position adjusting mechanism 53$c$ is $-\lambda+(\kappa+\lambda)\times(LL-LC)/LL$. An exposure adjustment position in the $\epsilon'$ direction is $+\lambda-(\kappa+\lambda)\times(LL-LC)/LL$. In the adjustment in this case, in the same manner as described above, the exposure adjustment position of the light-emitting element $4b_2$ in the center already adjusted is prevented from shifting.

Exposure adjustment positions in the respective directions of the first and second position adjusting mechanisms 52*c* and 53*c* are adjusted to the exposure adjustment positions at the time when the focused ranges of the light-emitting elements $4b_1$ and $4b_3$ at both the ends in the respective patterns E and F are the maximum. Consequently, exposure positions of the light-emitting elements $4b_1$ and $4b_3$ at both the ends are adjusted to be best focused. In this way, exposure positions of the light-emitting elements $4b_1$, $4b_2$, and $4b_3$ in the three rows further are adjusted to be best focused.

Figure 7:
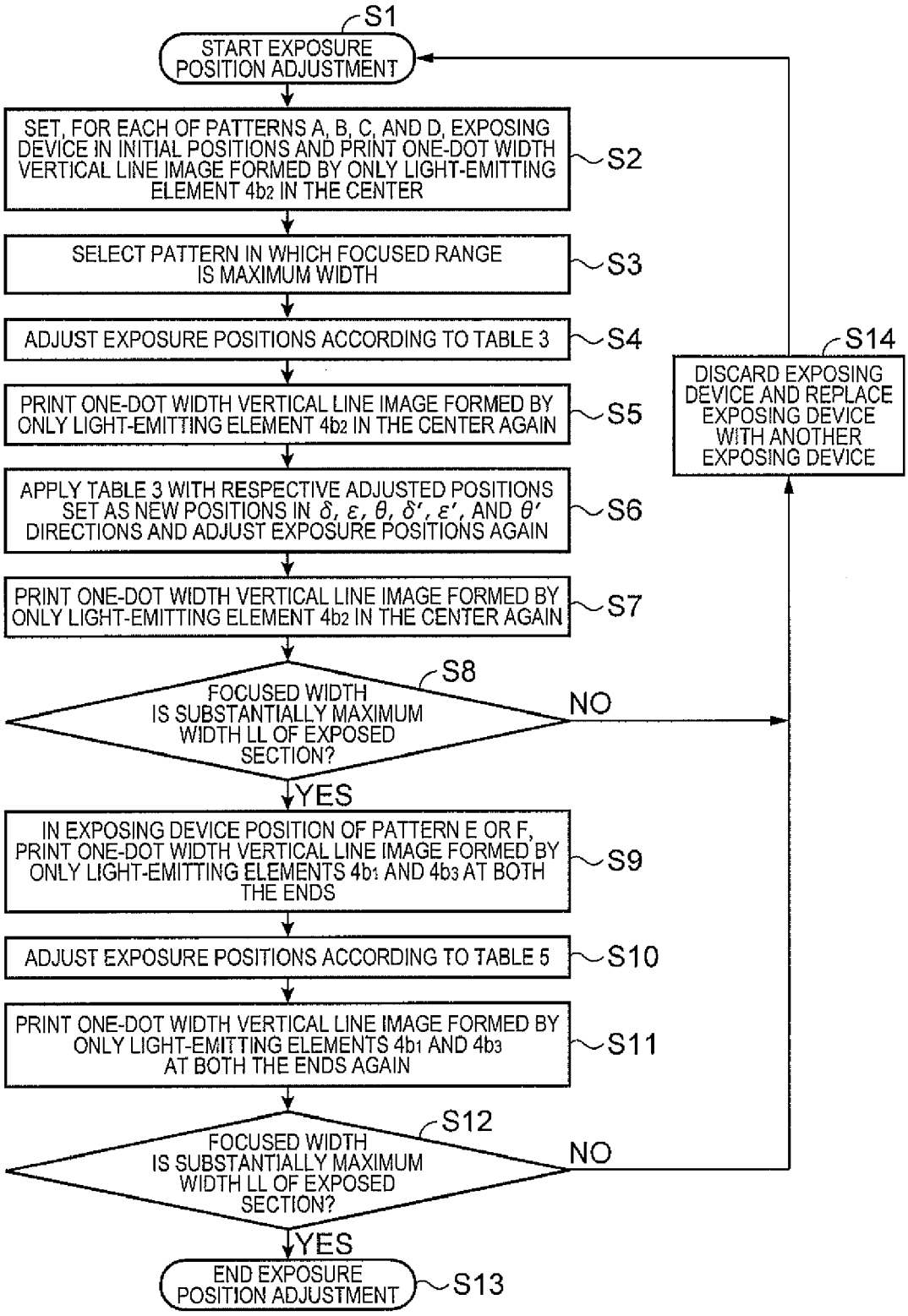
FIG. 7 is a flowchart showing a flow of a procedure for performing exposure position adjustment by the exposure-position adjusting device of the example shown in FIG. 5.

FIG. 7 is a flowchart showing a flow of a procedure for performing exposure position adjustment by the exposure-position adjusting device.

As shown in FIG. 7, first, in step S1, the exposure position adjustment is started. Subsequently, in step S2, the exposure-position adjusting device sets, for each of the patterns A, B, C, and D, the exposing device 4 in initial positions of the patterns. Thereafter, the exposure-position adjusting device prints, for each of the patterns A, B, C, and D, a one-dot width vertical line (sub-scanning direction) image formed by only the light-emitting element $4b_2$ in the center. In step S3, the exposure-position adjusting device selects a pattern in which a focused range 55*a* is the maximum width.

Subsequently, in step S4, the exposure-position adjusting device adjusts exposure positions according to an exposure adjustment position of the selected pattern among the patterns described in Table 3. In the next step S5, the exposure-position adjusting device prints the one-dot width vertical line image formed by only the light-emitting element $4b_2$ in the center again. In step S6, the exposure-position adjusting device applies Table 3 with the respective adjusted positions set as new positions in the $\delta$, $\epsilon$, $\theta$, $\delta'$, $\epsilon'$, and $\theta'$ directions and adjusts the exposure positions again.

In step S7, the exposure-position adjusting device prints the one-dot width vertical line image formed by only the light-emitting element $4b_2$ in the center again. Subsequently, in step S8, the exposure-position adjusting device judges whether the width of the focused range 55*a* of the printed one-dot width vertical line image is substantially maximum width LL of an exposed section. When it is judged that the width is the substantially maximum width LL of the exposed section, in step S9, the exposure-position adjusting device sets the exposing device 4 in the initial position of the pattern E or F described in Table 4. Thereafter, the exposure-position adjusting device prints a one-dot width vertical line image formed by only the light-emitting elements $4b_1$ and $4b_3$ at both the ends. In step S10, the exposure-position adjusting device adjusts the exposure positions according to the exposure adjustment positions of the pattern E or F described in Table 5. In step S11, the exposure-position adjusting device prints the one-dot width vertical line image formed by only the light-emitting elements $4b_1$ and $4b_3$ at both the ends.

Subsequently, in step S12, the exposure-position adjusting device judges whether the width of the focused range 55*a* of the printed one-dot width vertical line image is the substantially maximum width LL of the exposed section. When it is judged that the width is the substantially maximum width LL of the exposed section, in step S13, the exposure-position adjusting device finishes the adjustment of the exposure positions judging that all the light-emitting elements 4*b* in the three rows of the exposing device 4 are further best focused.

When it is judged in step S8 or S12 that the width of the focused range 55*a* is not the substantially maximum width LL of the exposed section, in step S14, the exposure-position adjusting device discards the exposing device 4 and replaces the exposing device 4 with another exposing device 4. Thereafter, the exposure-position adjusting device shifts to step S1 and starts exposure position adjustment. Subsequently, the exposure-position adjusting device executes the respective kinds of processing in steps S1 to S14 again in the same manner as described above.

The exposing device 4 of the image forming apparatus 1 according to this embodiment configured as described above includes the first and second position adjusting mechanisms 52*c* and 53*c* and 52*d* and 53*d* that rotate to adjust the two-dimensionally arrayed lens arrays 4*a* and the two-dimensionally arrayed light-emitting element 4*b* substantially around the axes in the main scanning direction in the center positions in the sub-scanning direction, which are the exposure positions of the respective light-emitting elements 4*b*. The exposing device 4 also includes the third position adjusting mechanisms 52*e* and 53*e* that move to adjust the lens arrays 4*a* and the two-dimensionally arrayed light-emitting elements 4*b* in the sub-scanning direction. This makes it possible to set the exposure positions of the respective light-emitting elements 4*b* in focused positions. Therefore, in conjunction with the advantages of the lens arrays 4*a* described above, it is possible to draw a more satisfactory latent image focused on the photosensitive member 2.

Moreover, since the exposure positions of the respective light-emitting elements 4*b* can be set in focused positions, when the exposing device 4 is built in the image forming apparatus 1, exposing devices 4 that do not pass a test can be reduced. Therefore, the yield of exposing devices 4 can be improved.

At least one side ends in the main scanning direction of the lens arrays 4*a* and the light-emitting elements 4*b* are supported on the photosensitive member 2 at two points in the sub-scanning direction. This makes it possible to simplify the configuration of the rotary exposure-position adjusting mechanism.

With the exposure-position adjusting method in this example, first, the respective light-emitting elements 4*b* and the respective lens arrays 4*a* are moved in the sub-scanning direction to adjust the center positions in the sub-scanning direction in the respective exposure positions. Then, the respective light-emitting elements 4*b* and the respective lens arrays 4*a* are rotated substantially around the axes in the main scanning direction in the center positions in the sub-scanning direction in the respective exposure positions to adjust positions at both the ends in the sub-scanning direction in the respective exposure positions. Consequently, the exposure positions of the respective light-emitting elements 4*b* can be more easily set in more highly accurately focused positions.

In the exposing device of the invention, the lens arrays 4*a* and the light-emitting elements 4*b* can be moved to be adjusted in the sub-scanning direction and can be moved to be adjusted in the direction orthogonal to both the main scanning direction and the sub-scanning direction. In this case, unlike the example described above, the position adjustment according to the rotation of the lens arrays 4*a* and the light-emitting elements 4*b* is not performed. However, the expected effect described above can be obtained and the problems described above can be solved. However, in order to set the exposure positions of the respective light-emitting elements 4*b* in more highly accurately focused positions, it is preferable to adjust positions of the lens arrays 4*a* and the light-emitting elements 4*b* according to the movement in the sub-scanning direction and the rotation around the axes in the main scanning direction.

Figure 13:
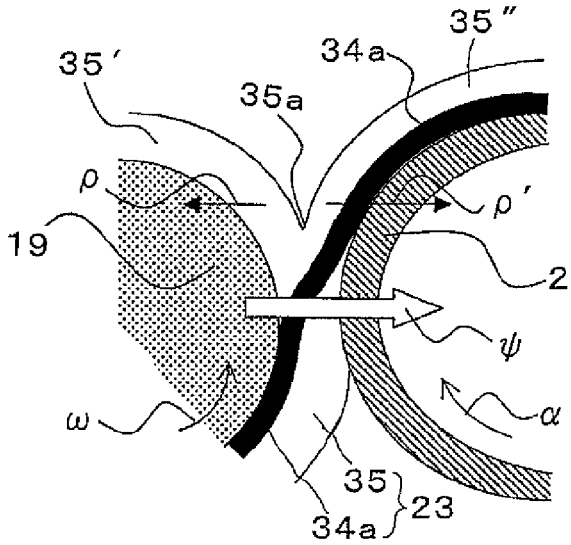
FIG. 13 is a diagram for explaining the behavior of a liquid developer that shifts from a developing roller to a photosensitive member.

In the image forming apparatus 1 of this example, the liquid developers 23Y, 23M, 23C, and 23K are used. As shown in FIG. 13, the liquid developer 23 is prepared by dispersing the liquid toner 34 containing a solid content toner (toner particles) 34*a* in the highly viscous nonvolatile liquid carrier 35.

Figure 14:
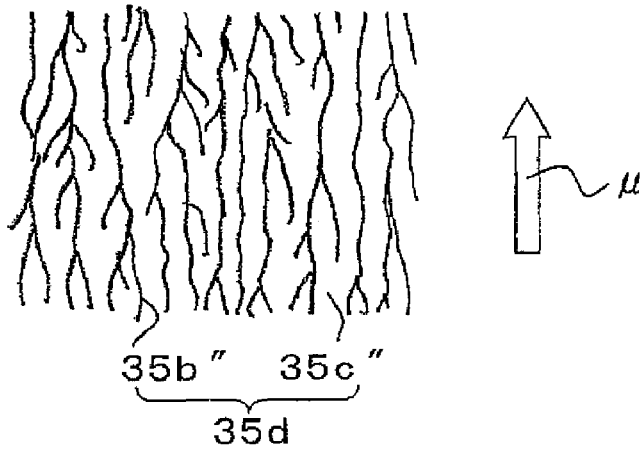
FIG. 14 is a diagram for explaining ribs in the liquid developer.

Since the liquid carrier 35 is highly viscous, after the liquid developer 23 carried according to the rotation in a ω direction of the developing roller 19 passes through the nip section between the developing roller 19 and the photosensitive member 2, the liquid carrier 35 is separated into a liquid carrier 35' adhering to the developing roller 6 and a liquid carrier 35" adhering to the photosensitive member 2. At this point, the liquid carrier 35 is pulled in an arrow ρ, ρ' direction in a carrier separating section 35*a* where both the liquid carriers 35' and 35" are separated. Therefore, pulsation occurs in the separated liquid carrier 35". As shown in FIG. 14, a rib 35*d* in which swelled portions 35*b*" and recessed portions 35*c*" are alternately present is formed in the photosensitive member 2. The rib 35*d* is formed to wave in generally the main scanning direction. The solid content toner 34*a* in the liquid carrier 35 is disturbed by the rib 35*d*.

Figure 15:
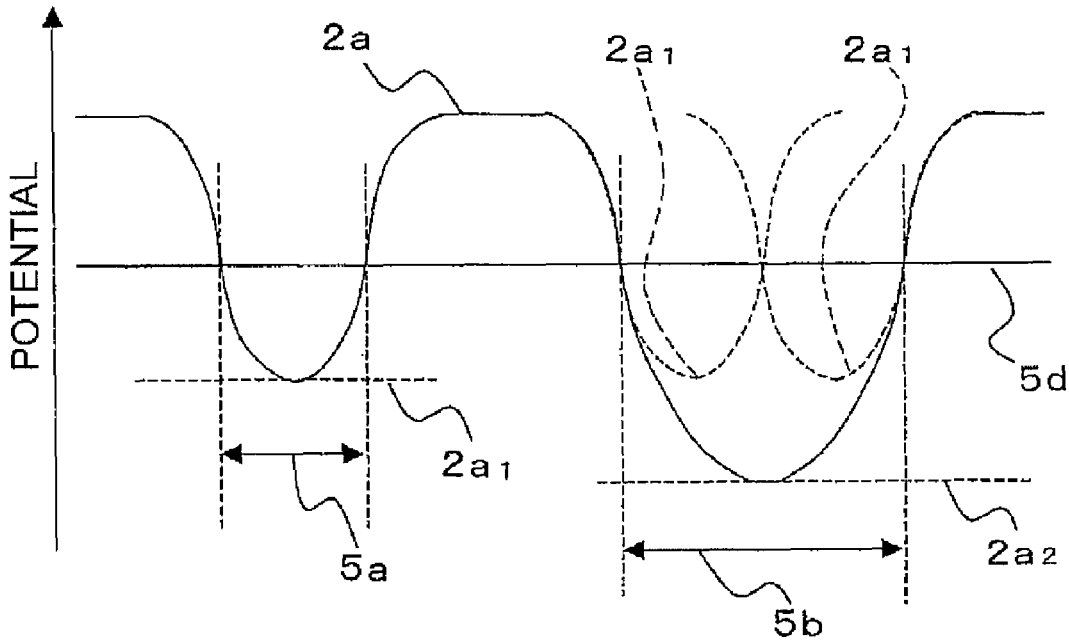
FIG. 15 is a diagram showing a relation between the magnitude of exposure light and latent image potential.

On the other hand, the magnitude of exposure and latent image potential have a relation shown in FIG. 15. Charging potential 2*a* of the exposed photosensitive member 2 is reduced by exposure energy. In FIG. 15, charging potential $2a_1$ is the charging potential of an exposed section by one-dot exposure. As shown in FIG. 15, charging potential $2a_2$ is the charging potential of an exposed section by two-dot exposure. In that case, the charging potential $2a_2$ of the exposed section by two-dot exposure is smaller than the charging potential $2a_1$ of the exposed section by one-dot exposure. The charging potential by two-dot exposure is larger than the exposure potential by one-dot exposure. In other words, exposure energy of exposure with two or more dots obtained by superimposing one dot is larger than exposure energy of one-dot exposure. Therefore, a development electric field between the developing device 5 and the photosensitive member 2 in an arrow ϕ direction shown in FIG. 13 is stronger in the exposed section of exposure with two or more dots than the exposed section by one-dot exposure.

Figure 16:
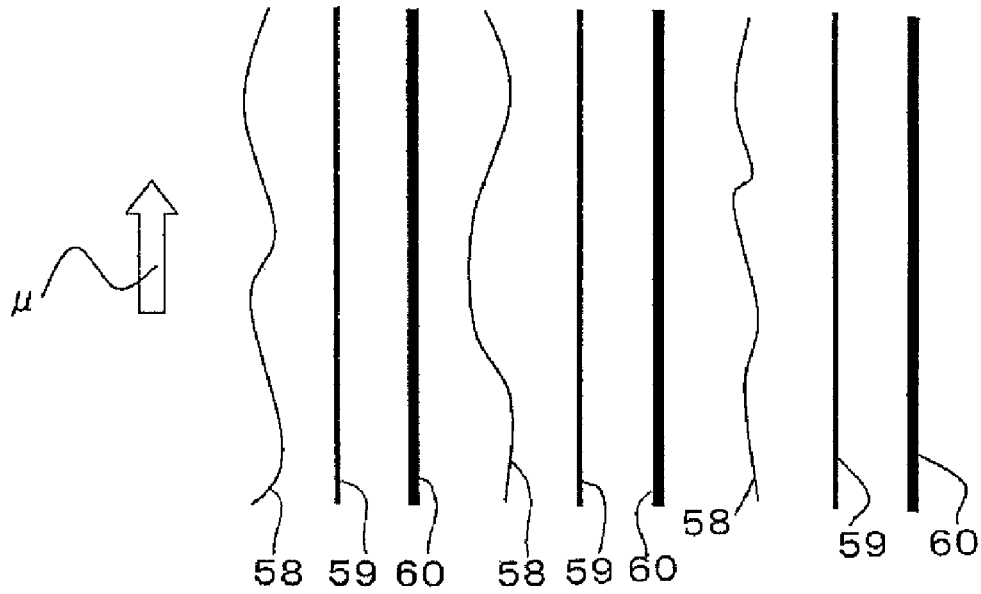
FIG. 16 is a diagram for explaining disorder of a one-dot width vertical line image.

When an exposure focus point of light from the light-emitting elements 4*b* shifts, i.e., when the light from the light-emitting elements 4*b* is not focused, the exposure energy decreases and the charging potential of the photosensitive member 2 by one-dot exposure shallows (does not substantially change from charging potential during uniform charging of the photosensitive member 2). Therefore, since the development electric field in one-dot exposure is weak as described above, a one-dot width vertical line image is disturbed by the rib 35*d*. Therefore, as shown in FIG. 16, in a one-dot width vertical line image 58, more disorders occur compared with a two-dot exposure width vertical line image 59 and a three-dot exposure width vertical line image 60.

Therefore, when the exposing device 4 of the invention that can set the exposure positions of the respective light-emitting elements 4*b* in focused positions is applied to an exposing device for the image forming apparatus 1 in which the liquid developer 23 is used, even the one-dot width vertical line image having a relatively weak development electric field can suppress disturbance due to the rib 35*d* of the liquid developer 23. In FIG. 15, 5*a* represents development width in one-dot width exposure, 5*b* represents development width in two-dot width exposure, and 5*d* represents development potential of the developing roller 19.

Examples and comparative examples of the exposure-position adjusting device of the exposing device of the invention are explained. The examples and the comparative examples are examples 1 and 2 and comparative examples 1 and 2. In all the examples, printing of a one-dot width vertical line image was performed after exposure adjustment was finished by using the exposing device 4 having the light-emitting elements 4*b* in the three rows shown in FIG. 3. Instead of the exposing device 4 attached with the exposure-position adjusting device as the exposing device 4C for cyan C of the image forming apparatus 1 of the tandem type in which the liquid developer shown in FIG. 1 is used, only an image forming unit for cyan was driven to perform printing. In that case, a toner image of cyan C was transferred from the photosensitive member 2C for cyan C to the recording material 54 via the intermediate transfer belt 10. A publicly-known photosensitive member of amorphous silicon is used as the photosensitive member 2C. As a toner, a toner of cyan C including particles having an average particle diameter of, for example, 2 μm prepared by dispersing pigment phthalocyanine blue of cyan in epoxy resin as thermoplastic resin was used. J paper manufactured by Fuji Xerox Co., Ltd. was used as the recording material 54 to perform experiments. Other conditions of the experiments were the same in the examples 1 and 2 and the comparative examples 1 and 2 except those described below. When the one-dot width vertical line image was observed by a microscope and it was admitted that the width of the focused range 55*a* was the substantially maximum width LL of the exposed section, it was determined that the exposing device passed a test and, otherwise, it was determined that the exposing device failed the test.

Example 1

In the example 1, adjustment of exposure positions was performed by using the first and second exposure-position adjusting devices 52 and 53 shown in FIGS. 2 and 5 and according to the flow of the procedure for exposure position adjustment shown in FIG. 7.

Example 2

Figure 8:
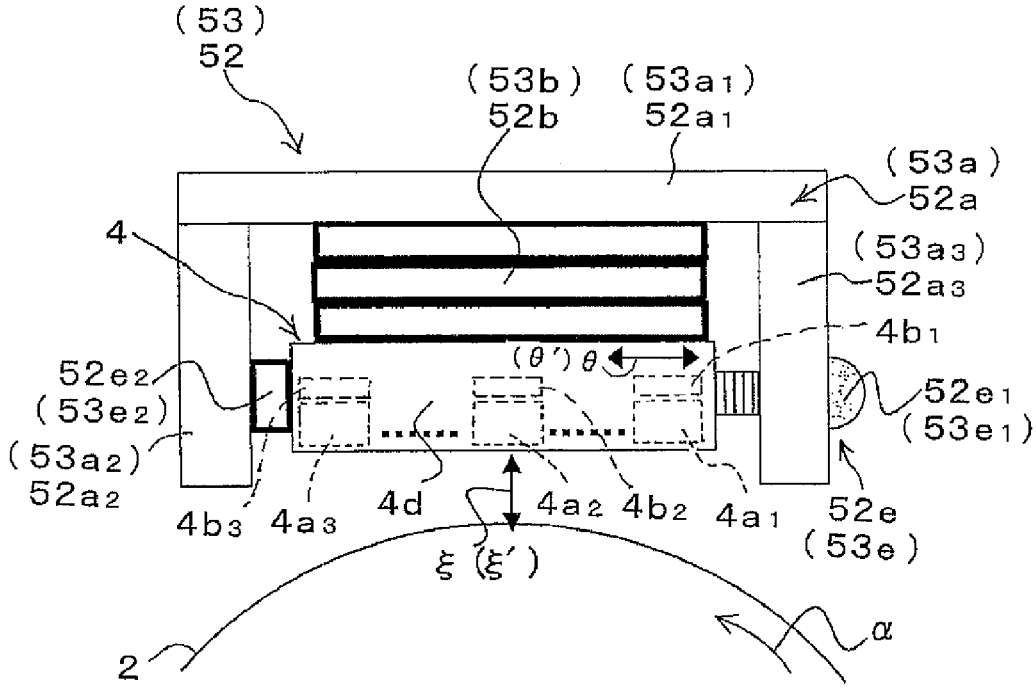
FIG. 8 is a sectional view similar to FIG. 5 schematically showing an exposure-position adjusting device in another example.
Figure 9:
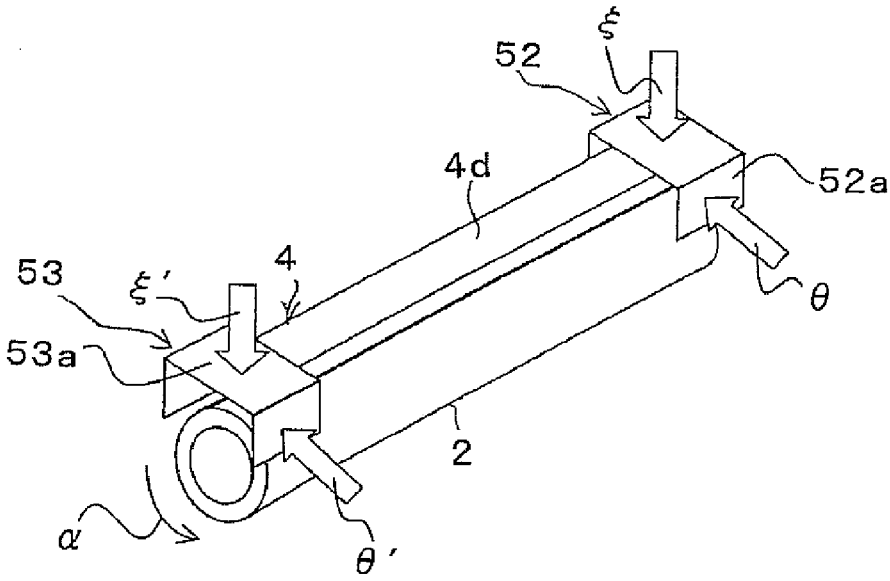
FIG. 9 is a perspective view similar to FIG. 2 schematically showing the exposure-position adjusting device of the example shown in FIG. 8.
Figure 10:
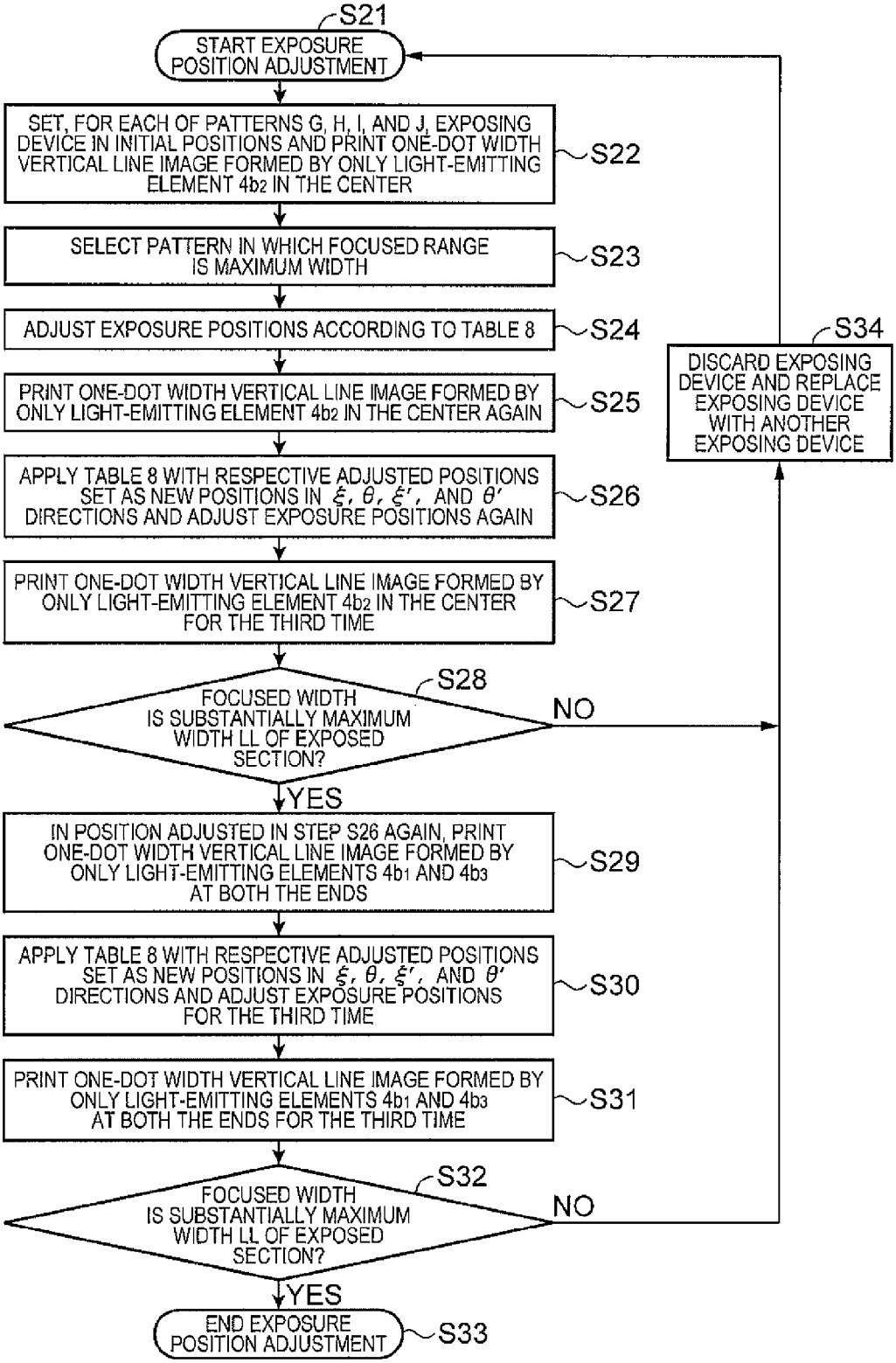
FIG. 10 is a flowchart showing a flow of a procedure for performing exposure position adjustment by the exposure-position adjusting device of the example shown in FIG. 8.

In the second example, adjustment of exposure positions was performed by using the first and second exposure-position adjusting devices 52 and 53 shown in FIGS. 8 and 9 and according to the flow of the procedure for exposure position adjustment shown in FIG. 10. As shown in FIGS. 8 and 9, in the example 2, a predetermined number of (three in the example shown in the figures) back spacers 52*b*' and 53*b*' having the thickness set in advance are provided between the light-emitting-element supporting member 4*d* of the exposing device 4 and the upper bottoms $52a_1$ and $53a_1$ of the exposing device supporting members 52*a* and 53*a*. The light-emitting-element supporting member 4*d* is screwed to the exposing device supporting members 52*a* and 53*a* by not-shown adjusting screws to adjust a distance in a ξ, ξ' direction between the lens array $4a_2$ located in the center in the width direction of the light-emitting-element supporting member 4*d* and the photosensitive member 2. In FIG. 8, the adjusting screws for performing exposure position adjustment in the ξ and ξ' directions are not shown. As the adjusting screws of the position adjusting mechanism that performs exposure position adjustment in the ξ and ξ' directions, the same adjusting screws as the first and second position adjusting screws $52c_1$ and $53c_1$ and $52d_1$ and $53d_1$ of the first and second position adjusting mechanisms 52*c* and 53*c* and 52*d* and 53*d* in the example 1 are used. The position adjusting mechanism that performs exposure position adjustment in the ξ and ξ' directions configures a main-and-sub-scanning-direction orthogonal-direction exposure-position adjusting unit as the first and second direction orthogonal-direction exposure-position adjusting units of the invention.

A predetermined number of (one in the example shown in the figure) back spacers 52$e'$ and 53$e'$ having the thickness set in advance are provided between the light-emitting-element supporting member 4$d$ and one sidewalls 52$a_2$ and 53$a_2$ of the exposure device supporting members 52$a$ and 53$a$. The light-emitting-element supporting member 4$d$ is screwed to the exposing device supporting members 52$a$ and 53$a$ by side screws 52$e_1'$ and 53$e_1'$ to adjust positions in the θ, θ' direction of the respective lens arrays 4$a_1$, 4$a_2$, and 4$a_3$ with respect to the photosensitive member 2.

Therefore, in the example 2, exposure position adjustment in the same θ and θ' directions as those in the example 1 and exposure position adjustment in the ξ and ξ' directions in the center position in the width direction of the exposing device 4 were performed.

As in the example 1, in the example 2, adjustment amount lower limit values, adjustment amount upper limit values, patterns as combinations of different initial positions, and exposure adjustment positions at the time when a focused range is the maximum are set. These are shown in Tables 6 to 8.

TABLE 6

| Direction | Adjustment amount lower limit value | Adjustment amount upper limit value |
|---|---|---|
| ξ | −dξ | +dξ |
| θ | −dθ | +dθ |
| ξ' | −dξ' | +dξ' |
| θ' | −dθ' | +dθ' |

Directions of Arrows in FIG. 9 are Positive Directions

As shown in Table 6, an adjustment amount lower limit value in the ξ direction of the first position adjusting mechanism 52$c$ is set to −dξ and an adjustment amount lower limit value in the θ direction of the first position adjusting mechanism 52$c$ is set to −dθ. An adjustment amount upper limit value in the ξ direction of the first position adjusting mechanism 52$c$ is set to +dξ and an adjustment amount upper limit value in the θ direction of the first position adjusting mechanism 52$c$ is set to +dθ. On the other hand, an adjustment amount lower limit value in the ξ' direction of the second position adjusting mechanism 53$c$ is set to −dξ' and an adjustment amount lower limit value in the θ' direction of the second position adjusting mechanism 53$c$ is set to −dθ'. An adjustment amount upper limit value in the ξ' direction of the second position adjusting mechanism 53$c$ is set to +dξ' and an adjustment amount upper limit value in the θ' direction of the second position adjusting mechanism 53$c$ is set to +dθ'.

TABLE 7

| Pattern | Direction | Initial position |
|---|---|---|
| Pattern G | ξ | −dξ |
| | θ | +dθ |
| | ξ' | +dξ' |
| | θ' | −dθ' |
| Pattern H | ξ | −dξ |
| | θ | −dθ |
| | ξ' | +dξ' |
| | θ' | +dθ' |
| Pattern I | ξ | +dξ |
| | θ | +dθ |
| | ξ' | −dξ' |
| | θ' | −dθ' |
| Pattern J | ξ | +dξ |
| | θ | −dθ |
| | ξ' | −dξ' |
| | θ' | +dθ' |

Directions of Arrows in FIG. 9 are Positive Directions

As shown in Table 7, as exposure position adjustment patterns of an exposure position adjustment image initially printed to adjust an exposure position of the light-emitting element 4$b_2$ in the center, in this example, four patterns G, H, I, and J are set. These patterns G, H, I, and J are combinations of various different initial positions in the ξ, θ, ξ', and θ' directions.

First, the pattern G is explained. As shown in Table 7, initial positions in the ξ and θ directions of the first position adjusting mechanism 52$c$ are set in positions of −dξ and +dθ, respectively. On the other hand, initial positions in the ξ' and θ' directions of the second position adjusting mechanism 53$c$ are set in positions of +dξ' and −dθ' respectively.

The pattern H is explained. As shown in Table 7, initial positions in the ξ and θ directions of the first position adjusting mechanism 52$c$ are set in positions of −dξ and −dθ, respectively. On the other hand, initial positions in the ξ' and θ' directions of the second position adjusting mechanism 53$c$ are set in positions of +dξ' and +dθ', respectively.

The pattern I is explained. As shown in Table 7, initial positions in the ξ and θ directions of the first position adjusting mechanism 52$c$ are set in positions of +dξ and +dθ, respectively. On the other hand, initial positions in the ξ' and θ' directions of the second position adjusting mechanism 53$c$ are set in positions of −dξ' and −dθ', respectively.

The pattern J is explained. As shown in Table 7, initial positions in the ξ and θ directions of the first position adjusting mechanism 52$c$ are set in positions of +dξ and −dθ, respectively. On the other hand, initial positions in the ξ' and θ' directions of the second position adjusting mechanism 53$c$ are set in positions of −dξ' and +dθ', respectively.

TABLE 8

| Pattern | Direction | Exposure adjustment position at the time when a focused range is the maximum |
|---|---|---|
| Pattern G | ξ | −dξ + (dξ + dξ') × LC/LL |
| | θ | +dθ − (dθ + dθ') × LC/LL |
| | ξ' | +dξ' − (dξ + dξ') × (LL − LC)/LL |
| | θ' | −dθ' + (dθ + dθ') × (LL − LC)/LL |
| Pattern H | ξ | −dξ + (dξ + dξ') × LC/LL |
| | θ | −dθ + (dθ + dθ') × LC/LL |
| | ξ' | +dξ' − (dξ + dξ') × (LL − LC)/LL |
| | θ' | +dθ' − (dθ + dθ') × (LL − LC)/LL |
| Pattern I | ξ | +dξ − (dξ + dξ') × LC/LL |
| | θ | +dθ − (dθ + dθ') × LC/LL |
| | ξ' | −dξ' + (dξ + dξ') × (LL − LC)/LL |
| | θ' | −dθ' + (dθ + dθ') × (LL − LC)/LL |
| Pattern J | ξ | +dξ − (dξ + dξ') × LC/LL |
| | θ | −dθ + (dθ + dθ') × LC/LL |
| | ξ' | −dξ' + (dξ + dξ') × (LL − LC)/LL |
| | θ' | +dθ' − (dθ + dθ') × (LL − LC)/LL |

Directions of Arrows in FIG. 9 are Positive Directions

An exposure adjustment position at the time when a focused range in the pattern G is the maximum is explained. As shown in Table 8, an exposure adjustment position in the ξ direction of the first position adjusting mechanism 52$c$ is −dξ+(dξ+dξ')×LC/LL. An exposure adjustment position in the θ direction is +dθ−(dθ+dθ')×LC/LL. On the other hand, an exposure adjustment position in the ξ' direction of the second position adjusting mechanism 53*c* is +dξ'−(dξ+dξ')×(LL−LC)/LL. An exposure adjustment position in the θ' direction is −dθ'+(dθ+dθ')×(LL−LC)/LL.

An exposure adjustment position at the time when a focused range in the pattern H is the maximum is explained. As shown in Table 8, an exposure adjustment position in the ξ direction of the first position adjusting mechanism 52*c* is −dξ+(dξ+ξ')×LC/LL. An exposure adjustment position in the θ direction is −dθ+(dθ+dθ')×LC/LL. On the other hand, an exposure adjustment position in the ξ' direction of the second position adjusting mechanism 53*c* is +dξ'−(dξ+dξ')×(LL−LC)/LL. An exposure adjustment position in the θ' direction is +dθ'−(dθ+dθ')×(LL−LC)/LL.

An exposure adjustment position at the time when a focused range in the pattern I is the maximum is explained. As shown in Table 8, an exposure adjustment position in the ξ direction of the first position adjusting mechanism 52*c* is +dξ−(dξ+dξ')×LC/LL. An exposure adjustment position in the θ direction is +dθ−(dθ+dθ')×LC/LL. On the other hand, an exposure adjustment position in the ξ' direction of the second position adjusting mechanism 53*c* is −dξ'+(dξ+dξ')×(LL−LC)/LL. An exposure adjustment position in the θ' direction is −dθ'+(dθ+dθ')×(LL−LC)/LL.

An exposure adjustment position at the time when a focused range in the pattern J is the maximum is explained. As shown in Table 8, an exposure adjustment position in the ξ direction of the first position adjusting mechanism 52*c* is +dξ−(dξ+dξ')×LC/LL. An exposure adjustment position in the θ direction is −dθ+(dθ+dθ')×LC/LL. On the other hand, an exposure adjustment position in the ξ' direction of the second position adjusting mechanism 53*c* is −dξ'+(dξ+dξ')×(LL−LC)/LL. An exposure adjustment position in the θ' direction is +dθ'−(dθ+dθ')×(LL−LC)/LL.

A procedure for exposure position adjustment in the example 2 is explained. FIG. 10 is a flowchart showing a flow of a procedure for performing exposure position adjustment by the first and second position adjusting mechanisms 52*c* and 53*c* shown in FIGS. 8 and 9.

As shown in FIG. 10, first, in step S21, the exposure position adjustment is started. Subsequently, in step S22, the first and second position adjusting mechanisms 52*c* and 53*c* set, for each of the patterns G, H, I, and J, the exposing device 4 in initial positions of the patterns. Thereafter, the first and second position adjusting mechanisms 52*c* and 53*c* print, for each of the patterns G, H, I, and J, a one-dot width vertical line image formed by only the light-emitting element $\mathbf{4}b_2$ in the center. In step S23, the first and second position adjusting mechanisms 52*c* and 53*c* select a pattern in which the focused range 55*a* is the maximum width.

Subsequently, in step S24, the first and second position adjusting mechanisms 52*c* and 53*c* adjust exposure positions according to an exposure adjustment position of the selected pattern among the patterns described in Table 8. In the next step S25, the first and second position adjusting mechanisms 52*c* and 53*c* print the one-dot width vertical line image formed by only the light-emitting element $\mathbf{4}b_2$ in the center again. In step S26, the first and second position adjusting mechanisms 52*c* and 53*c* apply Table 8 with the respective adjusted positions set as new positions in the ξ, θ, ξ', and θ' directions and adjust the exposure positions again. In step S27, the first and second position adjusting mechanisms 52*c* and 53*c* print the one-dot width vertical line image formed by only the light-emitting element $\mathbf{4}b_2$ in the center for the third time.

In step S28, the first and second position adjusting mechanisms 52*c* and 53*c* judge whether the width of the focused range 55*a* is substantially maximum width LL of an exposed section. When it is judged that the width is the substantially maximum width LL of the exposed section, in step S29, the first and second position adjusting mechanisms 52*c* and 53*c* print a one-dot width vertical line image formed by only the light-emitting elements $\mathbf{4}b_1$ and $\mathbf{4}b_3$ at both the ends in the exposure positions adjusted again in step S26. In step S30, the first and second position adjusting mechanisms 52*c* and 53*c* apply Table 8 with the respective adjusted positions set as new positions in the ξ, θ, ξ', and θ' directions and adjust the exposure positions for the third time. In step S31, the first and second position adjusting mechanisms 52*c* and 53*c* print the one-dot width vertical line image formed by only the light-emitting elements $\mathbf{4}b_1$ and $\mathbf{4}b_3$ at both the ends for the third time.

Subsequently, in step S32, the first and second position adjusting mechanisms 52*c* and 53*c* judge whether the width of the focused range 55*a* is the substantially maximum width LL of the exposed section. When it is judged that the width is the substantially maximum width LL of the exposed section, in step S33, the first and second position adjusting mechanisms 52*c* and 53*c* finish the adjustment of the exposure positions judging that all the light-emitting elements 4*b* in the three rows of the exposing device 4 are further best focused.

When it is judged in step S28 or S32 that the width of the focused range 55*a* is not the substantially maximum width LL of the exposed section, in step S34, the first and second position adjusting mechanisms 52*c* and 53*c* discard the exposing device 4 and replace the exposing device 4 with another exposing device 4. Thereafter, the first and second position adjusting mechanisms 52*c* and 53*c* shift to step S21 and start exposure position adjustment. Subsequently, the exposure-position adjusting device executes the respective kinds of processing in steps S21 to S34 again in the same manner as described above.

COMPARATIVE EXAMPLE 1

In the comparative example 1, a one-dot width horizontal line (main scanning direction) image was used as the exposure position adjustment image. When a horizontal line image is printed, lighting timing for the light-emitting element $\mathbf{4}b_2$ in the center and the light-emitting elements $\mathbf{4}b_1$ and $\mathbf{4}b_3$ at both the ends is controlled according to the moving speed of the photosensitive member 2 to make it possible to draw continuous images. In the comparative example 1, adjustment in the initial position of the exposing device is performed in the same manner as the example 1 but adjustment of exposure positions in the invention is not performed. In the comparative example 1, when the light-emitting elements 4*b* were not focused as shown in FIG. 11, since a one-dot width horizontal line latent image shallows, the solid content toner was disturbed by the rib described above. In a horizontal line image 56, there were a portion 56*a* where the horizontal line was cut, a portion 56*b* where the width of the horizontal line was disordered, and a portion 56*c*, where the horizontal line was blurred. In this way, when the light-emitting elements 4*b* are not focused, it is difficult to obtain a normal image. In FIG. 11, for convenience of explanation, some cases judged as the defocus of the light-emitting elements 4*b* such as the portion 56*a* where the horizontal line is cut and the portion 56*b* where the width of the horizontal line is disordered are collectively shown. When the exposure position adjustment image is the horizontal line image, not only a degree of the width disorder of the horizontal line is small but also the width disorder of the horizontal line is also caused by the irregularity in the rotating speed of the photosensitive member 2. Therefore, it is difficult to accurately judge a focused range in the one-dot width horizontal line.

COMPARATIVE EXAMPLE 2

Figure 12A:
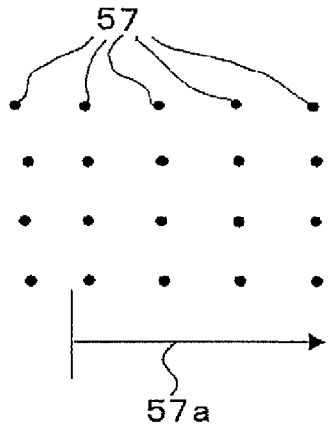
Figure 12B:
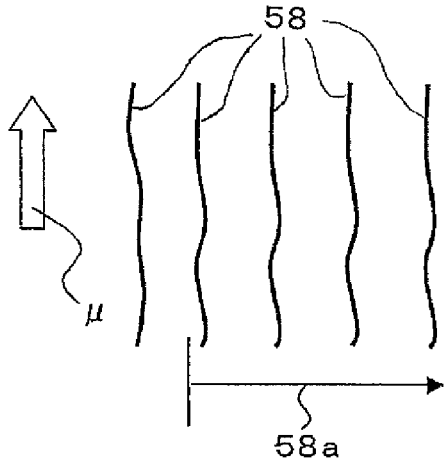

In the comparative example 2, a one-dot image and a one-dot width vertical line image were used as the exposure position adjustment image. In the comparative example 2, as in the comparative example 1, adjustment in the initial position of the exposing device is performed in the same manner as the example 1 but adjustment of exposure positions in the invention is not performed. As shown in FIG. 12A, since a one-dot image 57 is relatively aligned in an area 57*a* thereof, it is likely to be judged that the light-emitting elements 4*b* are focused. However, as shown in FIG. 12B, when a one-dot width vertical line image 58 is drawn as the exposure position adjustment image by the same exposing device 4, a continuous one-dot width vertical line image is not drawn in an area 58*a* (equivalent to the area 57*a*) and it is judged that the light-emitting elements 4*b* are not focused. Therefore, as in the case of the one-dot width horizontal line, it is difficult to accurately judge a focused range in the one-dot image. Therefore, it is preferable to use the one-dot width vertical line image 58 as the exposure position adjustment image because a focused range can be accurately judged.

Pass rates of exposing devices 4 in the examples 1 and 2 and the comparative examples 1 and 2 are shown in Table 9. In that case, when the focused width in the exposure position adjustment in the initial position was the substantially maximum width LL of the exposed section, it was judged that the exposing device 4 passed a test. When the width was smaller than the substantially maximum width LL of the exposed section, it was judged that the exposure device 4 failed the test. In Table 9, the pass rate of the exposing device 4 is represented as a percentage of the number of exposing devices that have passed the test among ten-thousand exposing devices in about one month. A pass rate of the exposing devices 4 equal to or higher than 80% was judged as acceptable. A pass rate lower than 80% was judged as unacceptable.

TABLE 9

| | Exposing device pass rate |
|---|---|
| Example 1 | 99.99% |
| Example 2 | 81.35% |
| Comparative example 1 | 78.82% |
| Comparative example 2 | 66.47% |

As shown in Table 9, the pass rate of the exposing devices 4 was 99.99%, 81.35%, 78.82%, and 66.47% in the example 1, the example 2, the comparative example 1, and the comparative example 2, respectively. Therefore, it was confirmed that a focused satisfactory latent image could be drawn on the photosensitive member 2 by performing the exposure position adjustment of the invention in the exposing device in which the lens arrays and the light-emitting element group were used. It was also confirmed that a focused satisfactory latent image could not be drawn on the photosensitive member 2 unless the exposure position adjustment of the invention was performed in the same exposing device.

Figure 17:
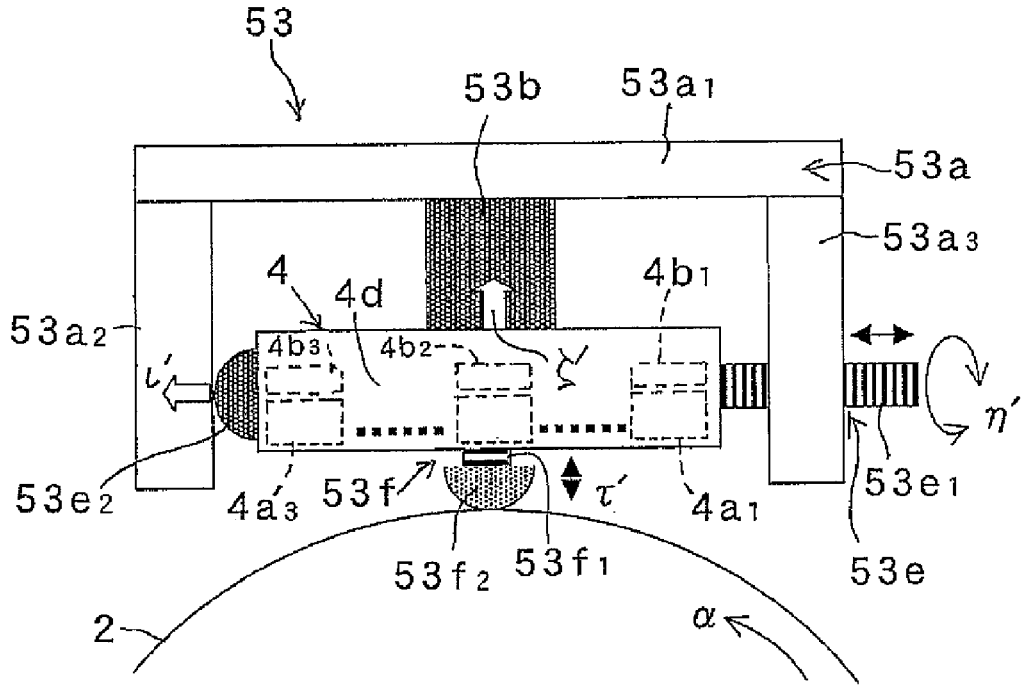
FIG. 17 is a diagram similar to FIG. 5 schematically and partially showing another example of the image forming apparatus according to the embodiment of the invention.

FIG. 17 is a diagram similar to FIG. 5 schematically and partially showing another example of the image forming apparatus according to the embodiment of the invention.

As shown in FIG. 17, in the exposing device 4 of this example, the second exposure-position adjusting device 53 includes one fourth position adjusting mechanism 53*f* instead of the first and second position adjusting mechanisms 53*c* and 53*d* of the exposing device 4 of the example shown in FIG. 5. The fourth position adjusting mechanism 53*f* includes, in the light-emitting element supporting member 4*d*, a fourth position adjusting screw $\mathbf{53}f_1$ provided to be located in the center or substantially the center in a longitudinal direction of the light-emitting element supporting member 4*d*. In that case, the fourth position adjusting screw $\mathbf{53}f_1$ is screwed in and pierces through the light-emitting element supporting member 4*d* in an up to down direction in FIG. 17. A semispherical lubricating member $\mathbf{53}f_2$ made of resin or the like having lubricity is fixed to a lower end of the fourth position adjusting screw $\mathbf{53}f_1$. A spherical surface section of the lubricating member $\mathbf{53}f_2$ is brought into contact with the outer peripheral surface of the non-image section of the photosensitive member 2.

The first exposure-position adjusting device 52 is the same as the first exposure-position adjusting device 52 of the example 1 shown in FIGS. 2 and 5. Therefore, the exposing device 4 of this example is supported at three points, i.e., at two points on the first exposure-position adjusting device 52 side and supported at one point on the second exposure-position adjusting device 53 side. Otherwise, configurations of the image forming apparatus 1 and the exposing device 4 of this example are the same as those in the example 1.

In the exposing device 4 of this example, adjustment of exposure positions is performed according to the same procedure as that in the example 1. In the exposing device 4 of this example, it is possible to obtain actions and effects equal to those in the example 1.

Figure 18:
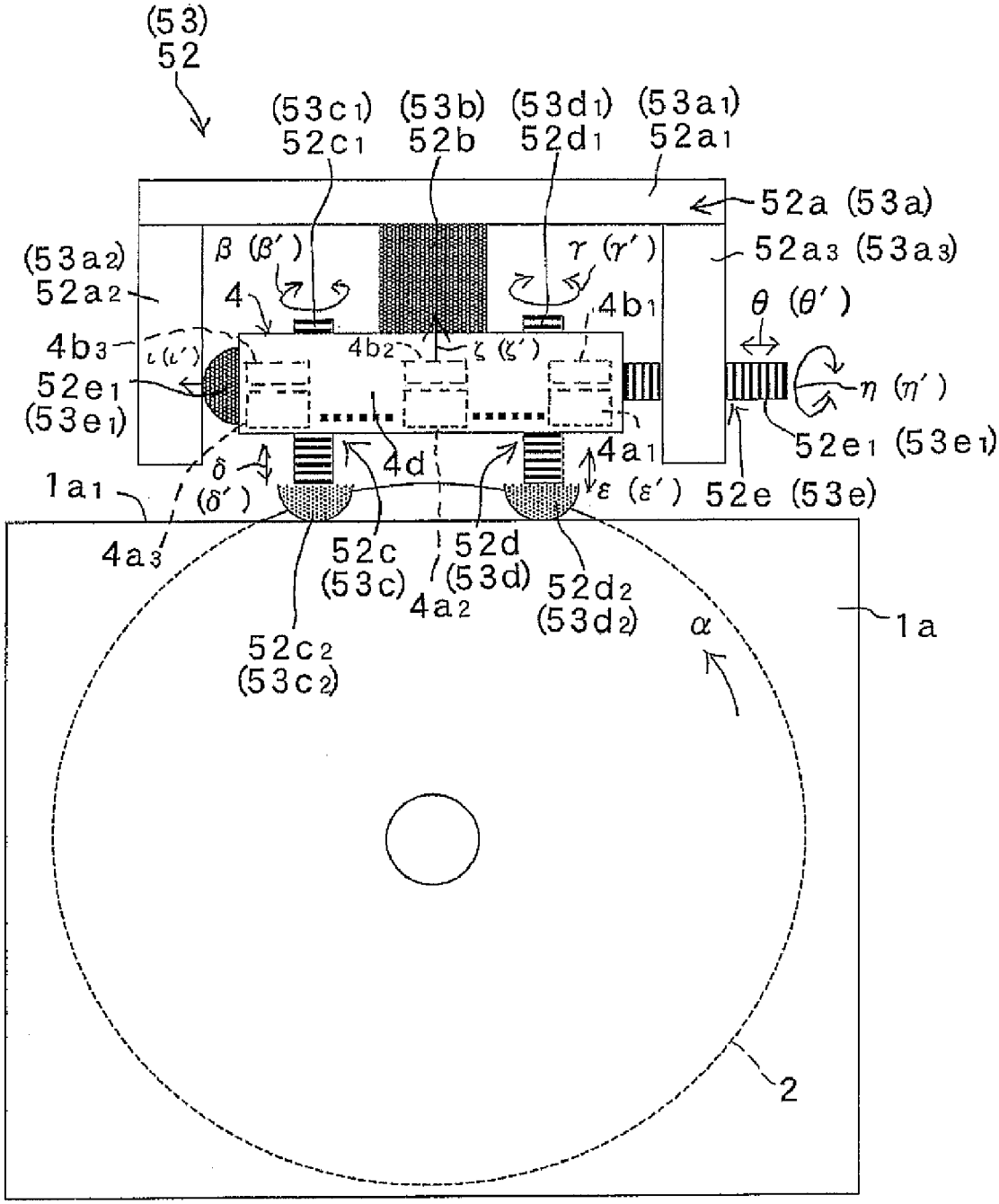
FIG. 18 is a diagram similar to FIG. 5 schematically and partially showing still another example of the image forming apparatus according to the embodiment of the invention.

FIG. 18 is a diagram similar to FIG. 5 schematically and partially showing still another example of the image forming apparatus according to the embodiment of the invention.

As shown in FIG. 18, in the exposing device 4 of this example, the first and second exposure-position adjusting devices 52 and 53 respectively include the two first and second position adjusting mechanisms 53*c* and 53*d* as in the example 1 shown in FIG. 5. In that case, in this example, as in the example 1, the first and second position adjusting mechanisms 53*c* and 53*d* respectively include the first and second position adjusting screws $\mathbf{52}c_1$ and $\mathbf{53}c_1$ and $\mathbf{52}d_1$ and $\mathbf{53}d_1$. At lower ends of the first and second position adjusting screws $\mathbf{52}c_1$ and $\mathbf{53}c_1$ and $\mathbf{52}d_1$ and $\mathbf{53}d_1$, the same semispherical lubricating members $\mathbf{52}c_2$ and $\mathbf{53}c_2$ and $\mathbf{52}d_2$ and $\mathbf{53}d_2$ as those in the example 1 are fixed. The spherical surface sections of the semispherical lubricating members $\mathbf{52}c_2$ and $\mathbf{53}c_2$ and $\mathbf{52}d_2$ and $\mathbf{53}d_2$ are supported on an upper surface $\mathbf{1}a_1$ in FIG. 18 of an apparatus main body 1*a* (equivalent to the flange that supports the photosensitive member 2 of the invention) located near the photosensitive member 2. Otherwise, configurations of the image forming apparatus 1 and the exposing device 4 in this example are the same as those in the example 1. In the exposing device 4 of this example, adjustment of exposure positions is performed according to the same procedure as that in the example 1.

With the exposing device 4 of this example, since the lens arrays $\mathbf{4}a_1$, $\mathbf{4}a_2$, and $\mathbf{4}a_3$ and the light-emitting elements $\mathbf{4}b_1$, $\mathbf{4}b_2$, and $\mathbf{4}b_3$ are supported on the apparatus main body 1*a* located near the photosensitive member 2, it is possible to suppress the influence of vibration generated from the photosensitive member 2 and perform stable drawing of an image. Other actions and effects of the exposing device 4 of this example are the same as those in the example 1.

Figure 19:
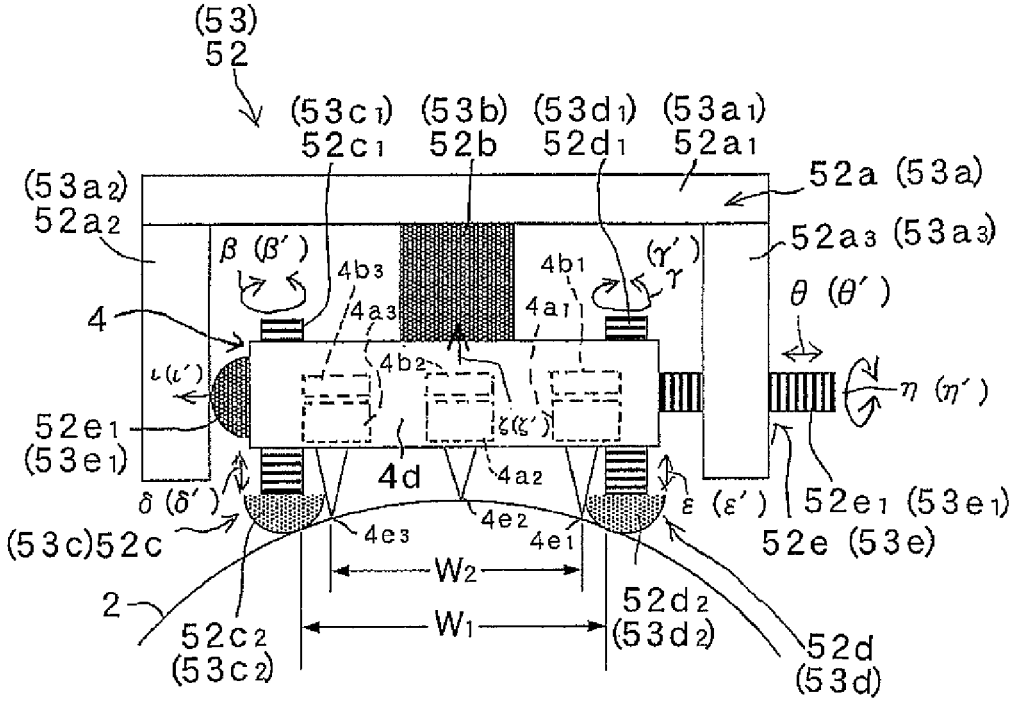
FIG. 19 is a diagram similar to FIG. 5 schematically and partially showing still another example of the image forming apparatus according to the embodiment of the invention.

FIG. 19 is a diagram similar to FIG. 5 schematically and partially showing still another example of the image forming apparatus according to the embodiment of the invention.

As shown in FIG. 19, in the exposing device 4 of this example, the first and second exposure-position adjusting devices 52 and 53 respectively include the two first and second position adjusting mechanisms 53*c* and 53*d* as in the example 1 shown in FIG. 5. In that case, in this example, as in the example 1, the first and second position adjusting mechanisms 53*c* and 53*d* respectively include the first and second position adjusting screws $\mathbf{52}c_1$ and $\mathbf{53}c_1$ and $\mathbf{52}d_1$ and $\mathbf{53}d_1$. At the lower ends of the first and second position adjusting screws $\mathbf{52}c_1$ and $\mathbf{53}c_1$ and $\mathbf{52}d_1$, and $\mathbf{53}d_1$, the same semispherical lubricating members $\mathbf{52}c_2$ and $\mathbf{53}c_2$ and $\mathbf{52}d_2$ and $\mathbf{53}d_2$ as those in the example 1 are fixed. The spherical surface sections of the semispherical lubricating members $\mathbf{52}c_2$ and $\mathbf{53}c_2$ and $\mathbf{52}d_2$ and $\mathbf{53}d_2$ are respectively set in contact with the outer peripheral surface of the non-image section of the photosensitive member 2.

All irradiation positions $\mathbf{4}e_1$, $\mathbf{4}e_2$, and $\mathbf{4}e_3$ on the surface of the photosensitive member 2 of the lens arrays $\mathbf{4}a_1$, $\mathbf{4}a_2$, and $\mathbf{4}a_3$ and the light-emitting elements $\mathbf{4}b_1$, $\mathbf{4}b_2$, and $\mathbf{4}b_3$ in the three rows are set among positions of contact with (supporting points on) the photosensitive member 2 of the spherical surface sections of the lubricating members $\mathbf{52}c_2$ and $\mathbf{53}c_2$ and $\mathbf{52}d_2$ and $\mathbf{53}d_2$ of the first and second position adjusting screws $\mathbf{52}c_1$ and $\mathbf{53}c_1$ and $\mathbf{52}d_1$ and $\mathbf{53}d_1$ in the sub-scanning direction. Therefore, maximum width $W_1$ in the sub-scanning direction of the supporting points on the photosensitive member 2 of the lubricating members $\mathbf{52}c_2$ and $\mathbf{53}c_2$ and $\mathbf{52}d_2$ and $\mathbf{53}d_2$ of the first and second position adjusting screws $\mathbf{52}c_1$ and $\mathbf{53}c_1$ and $\mathbf{52}d_1$ and $\mathbf{53}d_1$ is set larger than maximum width $W_2$ in the sub-scanning direction of the irradiation positions $\mathbf{4}e_1$, $\mathbf{4}e_2$, and $\mathbf{4}e_3$ on the surface of the photosensitive member 2 of the lens arrays $\mathbf{4}a_1$, $\mathbf{4}a_2$, and $\mathbf{4}a_3$ and the light-emitting elements $\mathbf{4}b_1$, $\mathbf{4}b_2$, and $\mathbf{4}b_3$ in the three rows (i.e., maximum width in the sub-scanning direction of irradiation areas of the light-emitting elements $\mathbf{4}b_1$, $\mathbf{4}b_2$, and $\mathbf{4}b_3$) ($W_1>W_2$). Otherwise, configurations of the image forming apparatus 1 and the exposing device 4 in this example are the same as those in the example 1. In the exposing device 4 of this example, adjustment of exposure positions is performed according to the same procedure as that in the example 1.

With the exposing device 4 of this example, the maximum width $W_1$ in the sub-scanning direction of the supporting points on the photosensitive member 2 of the first and second position adjusting screws $\mathbf{52}c_1$ and $\mathbf{53}c_1$ and $\mathbf{52}d_1$ and $\mathbf{53}d_1$ is set larger than the maximum width $W_2$ in the sub-scanning direction of the irradiation positions $\mathbf{4}e_1$, $\mathbf{4}e_2$, and $\mathbf{4}e_3$ on the surface of the photosensitive member 2 of the lens arrays $\mathbf{4}a_1$, $\mathbf{4}a_2$, and $\mathbf{4}a_3$ and the light-emitting elements $\mathbf{4}b_1$, $\mathbf{4}b_2$, and $\mathbf{4}b_3$. Therefore, it is possible to perform stable positioning of the exposing device 4. Adjustment amounts of the irradiation positions $\mathbf{4}e_1$, $\mathbf{4}e_2$, and $\mathbf{4}e_3$ of the lens arrays $\mathbf{4}a_1$, $\mathbf{4}a_2$, and $\mathbf{4}a_3$ and the light-emitting elements $\mathbf{4}b_1$, $\mathbf{4}b_2$, and $\mathbf{4}b_3$ are small compared with adjustment operation amounts of the first and second position adjusting screws $\mathbf{52}c_1$ and $\mathbf{53}c_1$ and $\mathbf{52}d_1$ and $\mathbf{53}d_1$. This makes it possible to more finely, more accurately, and more simply perform adjustment of the irradiation positions $\mathbf{4}e_1$, $\mathbf{4}e_2$, and $\mathbf{4}e_3$ of the lens arrays $\mathbf{4}a_1$, $\mathbf{4}a_2$, and $\mathbf{4}a_3$ and the light-emitting elements $\mathbf{4}b_1$, $\mathbf{4}b_2$, and $\mathbf{4}b_3$. Other actions and effects of the image forming apparatus 1 and the exposing device 4 in this example are the same as those in the example 1.

Figure 20:
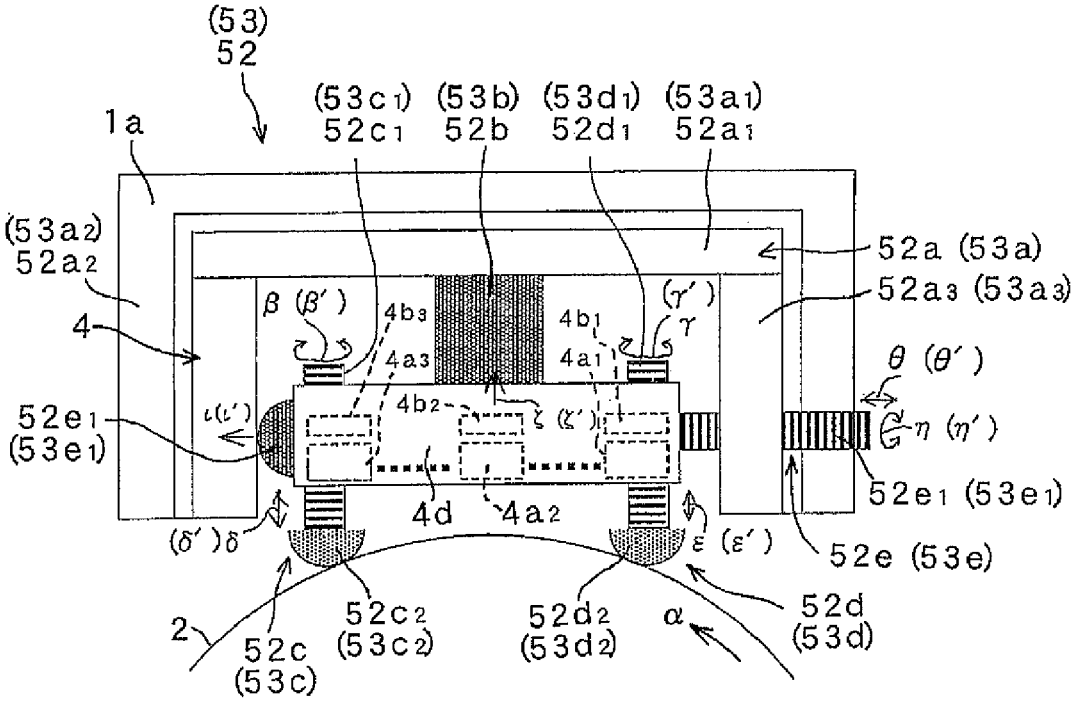
FIG. 20 is a diagram similar to FIG. 5 schematically and partially showing still another example of the image forming apparatus according to the embodiment of the invention.

FIG. 20 is a diagram schematically and partially showing another example of the image forming apparatus according to the embodiment of the invention.

In all the examples of the image forming apparatus according to the embodiment described above, the exposing device 4 is supported on the first and second exposure-position adjusting devices 52 and 53 supported by the apparatus main body 1*a* of the image forming apparatus 1. In all the examples, the exposing device 4 does not include the first and second exposure-position adjusting devices 52 and 53. On the other hand, as shown in FIG. 20, in the image forming apparatus 1 of this example, the first and second exposure-position adjusting devices 52 and 53 are incorporated in the exposing device 4. In other words, the exposing device 4 of this example includes the first and second exposure-position adjusting devices 52 and 53. The exposing device 4 itself is supported by the apparatus main body 1*a*. In that case, the first and second exposure-position adjusting devices 52 and 53 of the exposing device 4 are supported by the apparatus main body 1*a*. Since the exposing device 4 of this example includes the first and second exposure-position adjusting devices 52 and 53, it is easy to assemble the exposing device 4 to the apparatus main body 1*a*.

Other components and other actions and effects of the image forming apparatus 1 of this example are the same as those in the examples described above.

The invention is not limited to the examples of the image forming apparatus according to the embodiment. The invention can be applied to any exposing device and an image forming apparatus including the same as long as the exposing apparatus includes light-emitting element arrays and lens arrays respectively arrayed two-dimensionally in the main scanning direction as the first direction and the sub-scanning direction as the second direction. As the exposure-position adjusting mechanism of the invention, besides the exposure-position adjusting mechanism by the screws of the examples described above, other exposure-position adjusting mechanisms can also be used. In short, various design changes of the invention are possible without departing from the spirit and the scope of the invention.

The entire disclosure of Japanese Patent Application Nos: 2007-237643, filed Sep. 13, 2007 and 2008-148924, filed Jun. 6, 2008 are expressly incorporated by reference herein.

What is claimed is:

1. An exposing device comprising:

a light-emitting element array including a light-emitting element disposed in a first direction and a second direction orthogonal to or substantially orthogonal to the first direction;

a lens array that focus lights from the light-emitting elements;

a supporting member that supports the light-emitting element array and the lens array; and an exposure-position adjusting mechanism including a rotation adjusting unit that rotates the supporting member around or substantially around an axis in the first direction.

2. The exposing device according to claim 1, wherein the exposure-position adjusting mechanism includes a second-direction exposure-position adjusting unit that moves the supporting member in the second direction.

3. The exposing device according to claim 2, wherein the exposure-position adjusting mechanism includes first and second direction orthogonal-direction exposure-position adjusting units that move the supporting member in a direction orthogonal to both the first direction and the second direction.

4. An image forming apparatus comprising:

a latent image carrying member on which an electrostatic latent image is formed;

the exposing device according to claim 1 that draws the electrostatic latent image on the latent image carrying member; and a developing device that develops the electrostatic latent image with a developer.

5. An image forming apparatus comprising:

a latent image carrying member on which an electrostatic latent image is formed;

an exposing device including: a light-emitting element array including a light-emitting element disposed in a first direction and a second direction orthogonal to or substantially orthogonal to the first direction; a lens array that focus lights from the light-emitting elements; and a supporting member that supports the light-emitting element array and the lens array;

an exposure-position adjusting mechanism including a rotation adjusting unit that rotates the supporting member around or substantially around an axis in the first direction; and a developing device that develops the electrostatic latent image with a developer.

6. The image forming apparatus according to claim 4, wherein the developing device is a developing device that develops the electrostatic latent image with a liquid developer having a toner and a liquid carrier.

7. The image forming apparatus according to claim 4, wherein one side end of the supporting member is supported at two points on a photosensitive member or a flange that supports the photosensitive member.

8. The image forming apparatus according to claim 4, wherein one side end of the supporting member is supported at two or more points on a photosensitive member or a flange that supports the photosensitive member and the other side end thereof is supported at one or more points on the photosensitive member or the flange that supports the photosensitive member.

9. The image forming apparatus according to claim 7, wherein maximum width in the second direction of the supporting points on the one end side of the supporting member is larger than maximum width in the second direction of an irradiation area in the photosensitive member on which lights from the light-emitting elements are irradiated.

10. The image forming apparatus according to claim 4, wherein the rotation adjusting unit rotates the supporting member around or substantially around an axis in the first direction in a center position in the second direction in an exposure position.

* * * * *